US008899881B2

(12) United States Patent
Finn et al.

(10) Patent No.: US 8,899,881 B2
(45) Date of Patent: Dec. 2, 2014

(54) OFFSHORE TOWER FOR DRILLING AND/OR PRODUCTION

(75) Inventors: Lyle David Finn, Sugar Land, TX (US); Edward E. Horton, III, Houston, TX (US); James V. Maher, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 339 days.

(21) Appl. No.: 13/288,426

(22) Filed: Nov. 3, 2011

(65) Prior Publication Data

US 2012/0107052 A1 May 3, 2012

Related U.S. Application Data

(60) Provisional application No. 61/409,676, filed on Nov. 3, 2010.

(51) Int. Cl.
*B63B 35/44* (2006.01)
*B63B 21/50* (2006.01)

(52) U.S. Cl.
CPC ..... *B63B 21/50* (2013.01); *B63B 35/4413* (2013.01)
USPC ..... 405/200; 405/224; 114/264; 114/265

(58) Field of Classification Search
CPC ..... E02B 17/00; B63B 9/065; B63B 35/44; B63B 43/06; B63B 35/4413; B63B 2035/442
USPC ..... 405/200, 195.1, 203, 205, 207, 208, 405/210, 224, 196, 209; 114/264, 265
See application file for complete search history.

(56) References Cited

U.S. PATENT DOCUMENTS

| | | | | |
|---|---|---|---|---|
| 3,191,388 | A * | 6/1965 | Ludwig | 405/197 |
| 3,293,866 | A * | 12/1966 | Foster | 405/3 |
| 4,234,270 | A | 11/1980 | Gjerde et al. | |
| 4,423,983 | A | 1/1984 | Dadiras et al. | |
| 6,488,446 | B1 * | 12/2002 | Riemers | 405/203 |
| 6,783,302 | B2 | 8/2004 | Copple et al. | |
| 6,817,309 | B2 * | 11/2004 | Horton | 114/264 |
| 6,869,251 | B2 | 3/2005 | Zou et al. | |
| 2002/0139286 | A1 * | 10/2002 | Lee et al. | 114/264 |
| 2004/0105724 | A1 * | 6/2004 | Copple et al. | 405/195.1 |
| 2004/0253059 | A1 * | 12/2004 | Horton, III | 405/195.1 |

OTHER PUBLICATIONS

PCT/US2011/059083 International Search Report and Written Opinion dated Apr. 23, 2012 (9 p.).

* cited by examiner

*Primary Examiner* — Sean Andrish
(74) *Attorney, Agent, or Firm* — Conley Rose, P.C.

(57) ABSTRACT

An offshore structure comprises a hull having a longitudinal axis and including a first column and a second column moveably coupled to the first column. Each column has a longitudinal axis, a first end, and a second end opposite the first end. In addition, the offshore structure comprises an anchor coupled to the second end of the second column and configured to secure the hull to the sea floor. The first column includes a variable ballast chamber and a first buoyant chamber positioned between the variable ballast chamber and the first end of the first column. The first buoyant chamber is filled with a gas and sealed from the surrounding environment. The second column includes a variable ballast chamber. Further, the offshore structure comprises a topside mounted to the hull.

28 Claims, 23 Drawing Sheets

OFFSHORE TOWER FOR DRILLING AND/OR PRODUCTION

CROSS-REFERENCE TO RELATED APPLICATIONS

This application claims benefit of U.S. provisional patent application Ser. No. 61/409,676 filed Nov. 3, 2010, and entitled "Buoyant Tower Driller," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to offshore structures to facilitate offshore oil and gas drilling and production operations. More particularly, the invention relates to depth-adjustable offshore towers that are releasably secured to the sea floor and configured to pitch in response to environmental loads.

2. Background of the Technology

Various types of offshore structures may be employed to drill subsea wells and/or produce hydrocarbons (e.g., oil and gas) from subsea wells. Usually, the type of offshore structure selected for a particular application will depend on the depth of water at the well location. For instance, in water depths less than about 250 feet, conventional jackup platforms are commonly employed; in water depths between about 250 feet and 450 feet, specially designed "high spec" jackup platforms are commonly employed; in water depths less than about 600 feet, fixed platforms and compliant towers are commonly employed; and in water depths greater than about 600 feet, floating systems such as semi-submersible platforms and spar platforms are commonly employed.

Jackup platforms can be moved between different wells and fields, and are height adjustable. However, conventional jackup platforms are generally limited to water depths less than about 250 feet, and high spec jackup platforms are generally limited to water depths less than about 450 feet. Although conventional jackup platforms have low day rates, and thus, provide a low cost option in shallow waters, high spec jackup platforms have relatively high day rates and may be cost prohibitive. In addition, deployment and installation of jackup platforms, typically requiring both a launch barge and a derrick barge, can be challenging, especially in deeper waters. Jackup platforms may also be less desirable for use in earthquake zones since rigid bottom-founded jackup platforms exhibit very little compliance.

Fixed platforms include a concrete and/or steel jacket anchored directly to the sea floor, and a deck positioned above the sea surface and mounted to the upper end of the jacket. Fabrication and installation of a fixed platform requires a particular infrastructure and skilled labor. For example, launch barges are needed to transport the components of the jacket and the deck to the offshore installation site, derrick barges are needed to position and lift the upper portion of the jacket, and derrick barges are needed to lift and position the deck atop the jacket. In addition, installation of a fixed platform often requires the installation of piles that are driven into the seabed to anchor the jacket thereto. In deeper applications, additional skirt piles must also be driven into the seabed. In select geographic locations such as the Gulf of Mexico, fixed jacket platforms are fabricated, deployed, and installed on a regular basis. Accordingly, such regions typically have the experience, infrastructure, and skilled labor to enable fixed jacket platforms to provide a viable, competitive option for offshore drilling and/or production. In other regions, having little to no experience with fixed jacket platforms, the facilities, equipment, infrastructure, and labor may be insufficient to efficiently construct, deploy, and install a fixed jacket platform. Moreover, even in some regions, such as Brazil and Peru, that have some experience fabricating and installing fixed jacket platforms, the range of applications for fixed jacket platforms anticipated in the next few years may exceed present capabilities.

Fixed jacket platform are typically designed to have a natural period that is less than any appreciable, wave energy anticipated at the offshore installation site. This is relatively easy to accomplish in shallow waters. However, as water depths increase, the inherent compliance, and hence natural period, of the jacket increases. To reduce the natural period of the jacket below the anticipated wave energy as water depth increases, the jacket is stiffened by increasing the size and strength of the jacket legs and pilings. Such changes may further increase the infrastructure and labor requirements for fabrication and installation of the jacket. Similar to jackup platforms, since fixed platforms are rigid bottom-founded structures, they tend to be less desirable for use in earthquake zones.

Floating systems can be used in deep water and are suitable for use in earthquake zones since they are not rigidly connected to the sea floor. However, floating structures are relatively expensive and difficult to move between different locations since they are designed to be moored (via multiple mooring lines) at a specific location for an extended period of time. In addition, the lower ends of the mooring lines are typically anchored to the sea floor with relatively large piles driven into the sea bed. Such piles are difficult to handle, transport, and install at substantial water depths.

Accordingly, there remains a need in the art for offshore drilling and/or production bottom-founded structures anchored to the sea floor that are easily installed (e.g., lower infrastructure and specialized labor requirements) and moved between different offshore locations. Such offshore productions systems would be particularly well-received if they were economical, suitable for use in earthquake zones, and could be employed in different water depths.

BRIEF SUMMARY OF THE DISCLOSURE

These and other needs in the art are addressed in one embodiment by an offshore structure for drilling and/or producing a subsea well. In an embodiment, the offshore structure comprises a hull having a longitudinal axis and including a first column and a second column moveably coupled to the first column. Each column has a longitudinal axis, a first end, and a second end opposite the first end. In addition, the offshore structure comprises an anchor coupled to the second end of the second column and configured to secure the hull to the sea floor. The first column includes a variable ballast chamber positioned axially between the first end and the second end of the first column and a first buoyant chamber positioned between the variable ballast chamber and the first end of the first column. The first buoyant chamber is filled with a gas and sealed from the surrounding environment. The second column includes a variable ballast chamber positioned axially between the first end and the second end of the second column. Further, the offshore structure comprises a topside mounted to the hull.

These and other needs in the art are addressed in another embodiment by a method for drilling and/or producing one or more offshore wells. In an embodiment, the method comprises a (a) positioning a buoyant tower at an offshore installation site. The tower includes a hull having a longitudinal axis, a topside mounted to a first end of the hull, and an anchor coupled to a second end of the hull. The hull includes a center column and a plurality of outer columns circumferentially spaced about the center column. The center column is moveably coupled to the outer columns. In addition, the method comprises (b) ballasting the center column. Further, the method comprises (c) moving the center column axially downward relative to the outer columns. Still further, the method comprises (d) ballasting the outer columns. Moreover, the method comprises (e) penetrating the sea floor with the anchor. The method also comprises (f) allowing the tower to pitch about the lower end of the hull after (e).

These and other needs in the art are addressed in another embodiment by an offshore structure for drilling and/or producing a subsea well. In an embodiment, the offshore structure comprises a hull having a longitudinal axis and including a plurality of radially outer columns and a center column radially positioned between the outer columns. Each column is oriented parallel to the longitudinal axis. Each column has a first end and a second end opposite the first end. The center column is configured to move axially relative to the outer columns. In addition, the offshore structure comprises an anchor connected to the second end of the center column, wherein the anchor has an aspect ratio less than 3:1 and is configured to releasably engage the sea floor. Each outer column includes a variable ballast chamber positioned axially between the first end and the second end of the outer column and a first buoyant chamber positioned axially between the variable ballast chamber and the first end of the outer column. The first buoyant chamber is filled with a gas and sealed from the surrounding environment. The center column includes a variable ballast chamber positioned axially between the first end and the second end of the center column. Further, the offshore structure comprises a topside mounted to the hull.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE PREFERRED EMBODIMENTS

Figure 1:
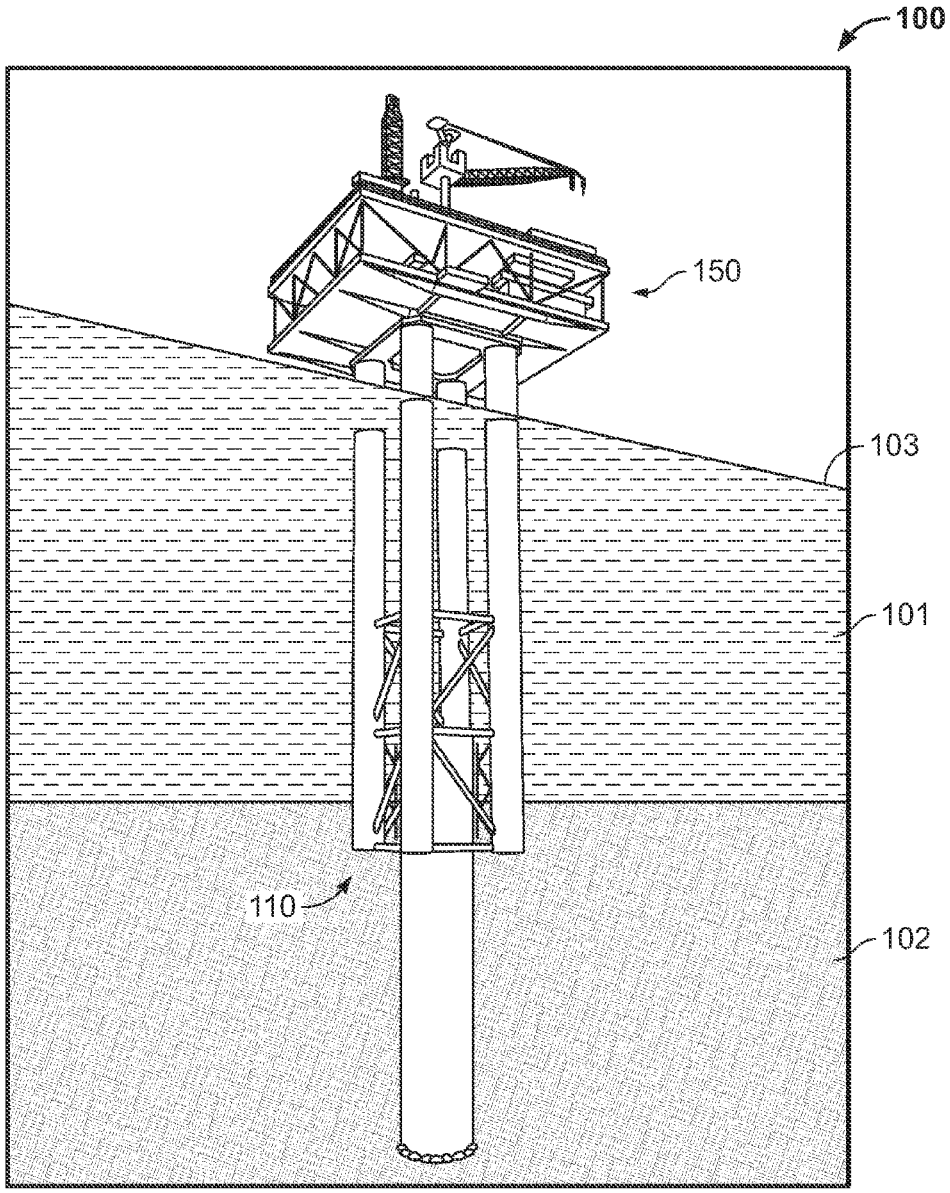
FIG. 1 is a perspective view of an embodiment of an offshore tower in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
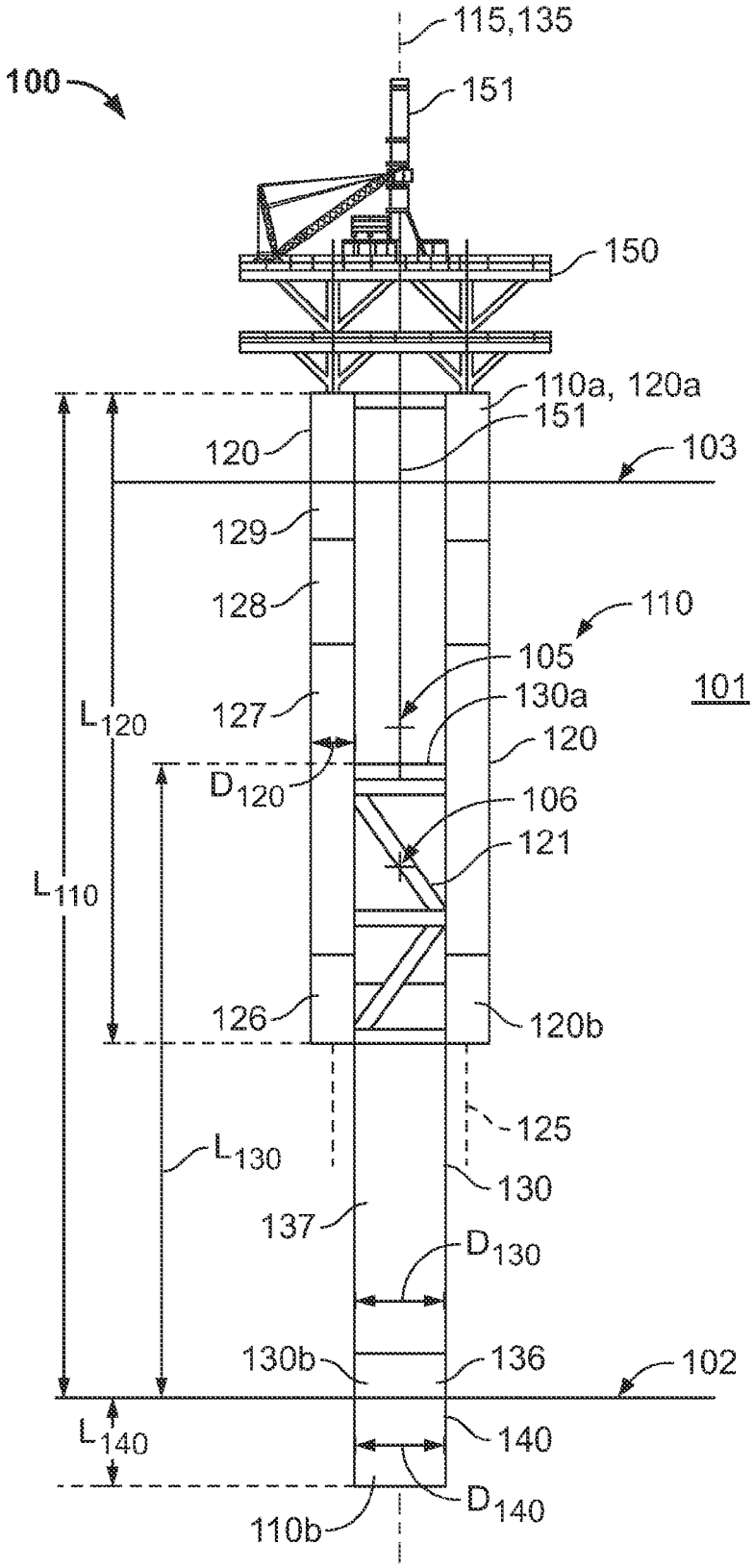
FIG. 2 is a front view of the tower of FIG. 1 with the center column of the hull in an extended position and anchored to the sea floor.

Referring now to FIGS. 1 and 2, an embodiment of an extendable offshore tower 100 in accordance with the principles disclosed herein is shown. Tower 100 is shown deployed in a body of water 101 and releasably coupled to the sea floor 102 at an offshore site. Consequently, tower 100 may be referred to as a "bottom-founded" structure, it being understood that bottom-founded offshore structures are anchored directly to the sea floor and do not rely on mooring systems to maintain their position at the installation site. In general, tower 100 may be deployed offshore to drill a subsea wellbore and/or produce hydrocarbons from a subsea wellbore. In this embodiment, tower 100 includes an elongate hull 110 and a topside or deck 150 mounted to hull 110 above the sea surface 103.

Hull 110 has a central or longitudinal axis 115, a first or upper end 110*a* extending above the sea surface 103, and a second or lower end 110*b* opposite end 110*a*. Hull 110 is releasably secured to the sea floor 102 with an anchor 140 coupled to lower end 110*b*. Hull 110 has a length $L_{110}$ measured axially from end 110*a* to end 110*b*. As will be described in more detail below, the length $L_{110}$ of hull 110 may be adjusted (i.e., increased or decreased) for installation in various water depths. However, embodiments of tower 100 described herein are particularly suited for deployment and installation in water depths ranging from about 200 feet to 600 feet.

Figure 3:
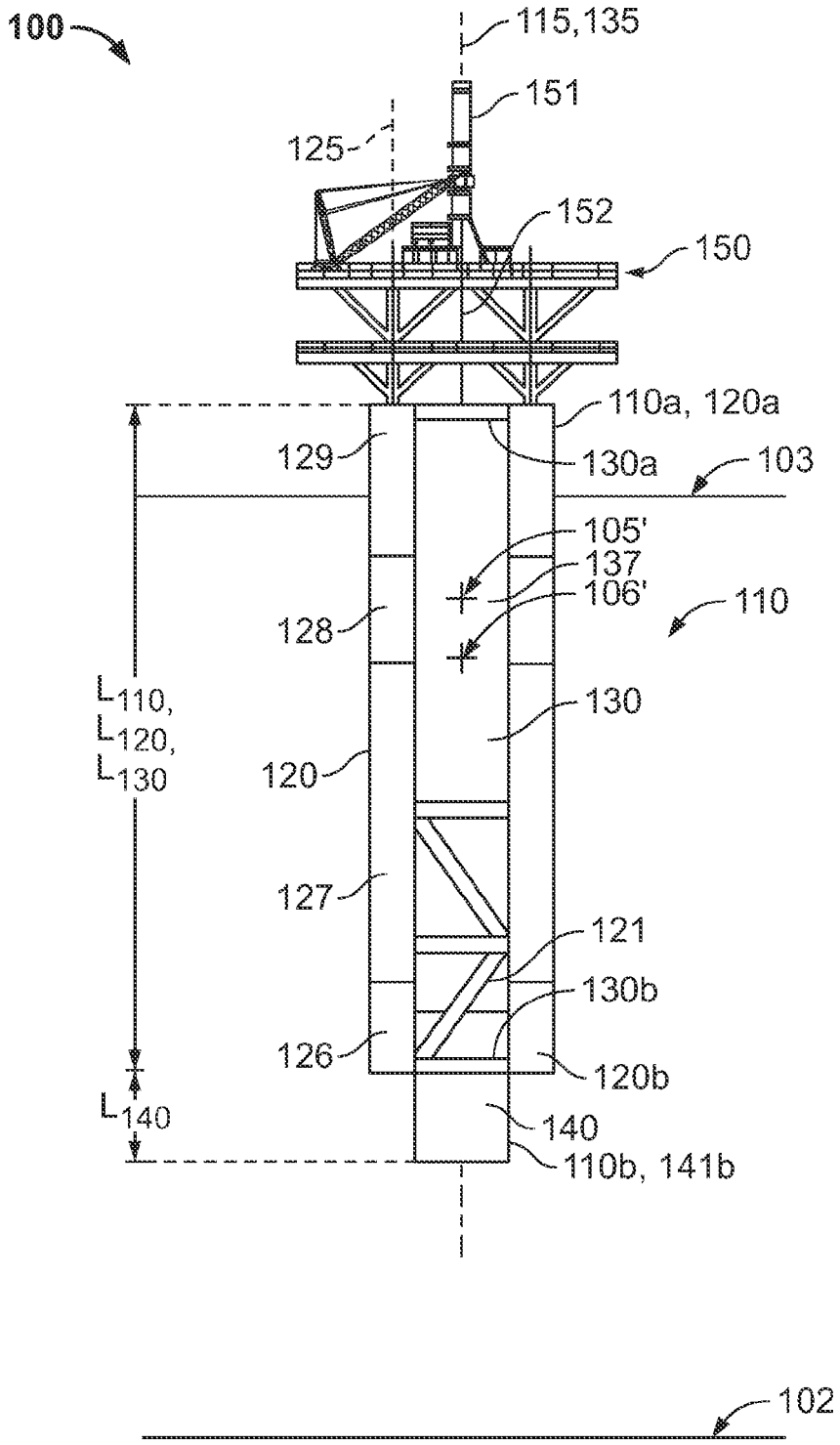
FIG. 3 is a front view of the tower of FIG. 1 with the center column of the hull in a refracted position and decoupled from the sea floor.

As best shown in FIGS. 2 and 3, hull 110 comprises a plurality of radially outer columns 120 and a radially inner or center column 130 disposed between columns 120. Elongate cylindrical columns 120, 130 are oriented parallel to each other. In this embodiment, hull 110 includes four columns 120 generally arranged in a square configuration and uniformly circumferentially spaced about axis 115, and one center column 130 disposed in the center of columns 120 coaxially aligned with axis 115. Columns 120 are coupled together by a plurality of truss members 121 extending between adjacent columns 120, and thus, columns 120 do not move rotationally or translationally relative to each other. However, center column 130 is moveably coupled to columns 120. In particular, center column 130 may be axially extended and refracted relative to columns 120. In FIG. 2, center column 130 is shown axially extended from columns 120, and in FIG. 3, center column 130 is shown axially refracted within columns 120.

Referring still to FIGS. 2 and 3, each outer column 120 has a central or longitudinal axis 125 oriented parallel to axis 115, a first or upper end 120*a* extending above the sea surface 103, and a second or lower end 120*b* opposite end 120*a*. Upper ends 120*a* define upper end 110*a* of hull 110. Deck 150 is attached to upper end 120*a* of each column 120.

Each column 120 has a length $L_{120}$ measured axially between ends 120*a, b*. In addition, each column 120 has a diameter $D_{120}$ measured perpendicular to its corresponding axis 125 in side view (FIG. 2). In this embodiment, each column 120 is identical. Thus, the length $L_{120}$ and diameter $D_{120}$ of each column 120 is the same. In general, the length $L_{120}$ and the diameter $D_{120}$ of each column 120 may be tailored to the particular installation location and associated water depth. For most installation locations having a water depth of 200 to 600 ft., the length $L_{120}$ of each column 120 is preferably between 150 and 500 ft.; and the diameter $D_{120}$ is preferably between 15 ft. and 25 ft. However, depending on the particular installation location and desired dynamic behavior of tower 100 under environmental loads, length $L_{120}$ and diameter $D_{120}$ may be varied and adjusted as appropriate.

Figure 4:
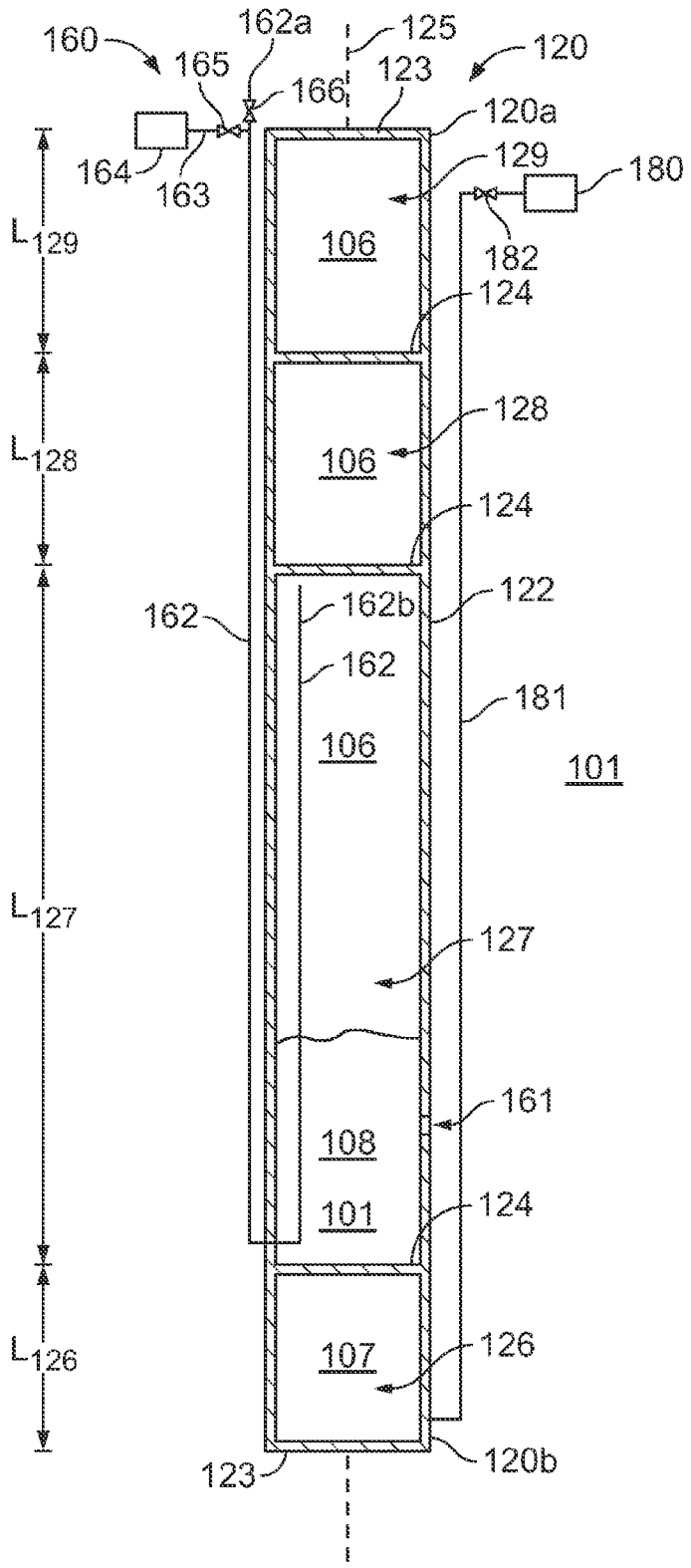
FIG. 4 is a cross-sectional view of one of the outer columns of the hull of FIG. 2.

Referring now to FIG. 4, one outer column 120 is schematically shown, it being understood that each column 120 of hull 110 is configured the same. In this embodiment, column 120 comprises a radially outer tubular 122 extending between ends 120*a, b*, upper and lower end caps 123 at ends 120*a, b*, respectively, and a plurality of axially spaced bulkheads 124 positioned within tubular 122 between ends 120*a, b*. End caps 123 and bulkheads 124 are each oriented perpendicular to axis 125. Together, tubular 122, end caps 123, and bulkheads 124 define a plurality of axially stacked compartments or cells within column 120—a fixed ballast chamber 126 at lower end 120*b*, a variable ballast or ballast adjustable chamber 127 axially adjacent chamber 126, and a pair of buoyant chambers 128, 129 axially disposed between upper end 120*a* and ballast adjustable chamber 127. Each chamber 126, 127, 128, 129 has a length $L_{126}$, $L_{127}$, $L_{128}$, $L_{129}$, respectively, measured axially between its axial ends. The length $L_{126}$, $L_{127}$, $L_{128}$, $L_{129}$ of each chamber 126, 127, 128, 129, respectively, is preferably between 10 and 80 ft. In particular, length $L_{126}$ is preferably between 10 and 30 ft., length $L_{127}$ is preferably between 20 and 60 ft., and each length $L_{128}$, $L_{129}$ is preferably between 15 and 40 ft. However, depending on the particular installation location and desired dynamic behavior of tower 100 under environmental loads, each length $L_{126}$, $L_{127}$, $L_{128}$, $L_{129}$ may be varied and adjusted as appropriate.

End caps 123 close off ends 120*a, b* of column 120, thereby preventing fluid flow through ends 120*a, b* into chambers 126, 129, respectively. Bulkheads 124 close of the remaining ends of chambers 126, 127, 128, 129, thereby preventing fluid communication between adjacent chambers 126, 127, 128, 129. Thus, each chamber 126, 127, 128, 129 is isolated from the other chambers 126, 127, 128, 129 in column 120.

Chambers 128, 129 are filled with a gas 106 and sealed from the surrounding environment (e.g., water 101), and thus, provide buoyancy to column 120 during offshore transport and installation of hull 110, as well as during operation of tower 100. Accordingly, chambers 128, 129 may also be referred to as buoyant chambers. In this embodiment, gas 106 is air, and thus, may also be referred to as air 106. As will be described in more detail below, during offshore transport of hull 110, fixed ballast chamber 126 and variable ballast chamber 127 are also filled with air 106, thereby contributing to the buoyancy of column 120. However, during installation of hull 110, chamber 126 is filled with fixed ballast 107 (e.g., water, iron ore, etc.) to increase the weight of column 120 and orient column 120 and hull 110 upright. During offshore drilling and/or production operations with tower 100, the fixed ballast 107 in chamber 126 is generally permanent (i.e., remains in place). During installation of hull 110 at the offshore operation site, ballast 108 is controllably added to ballast adjustable chamber 127 to decrease the buoyancy of column 120 and orient column 120 and hull 110 upright. However, unlike fixed ballast chamber 126, during offshore drilling and/or production operations with tower 100, ballast 108 in chamber 127 may be controllably varied (i.e., increased or decreased), as desired, to vary the buoyancy of column 120 and hull 110. Two buoyant chambers 128, 129 are included in column 120 to provide redundancy and buoyancy in the event there is damage or a breach of one buoyant chamber 128, 129, uncontrolled flooding of ballast adjustable chamber 127, or combinations thereof. In this embodiment, variable ballast 108 is water 101, and thus, may also be referred to as water 108.

As best shown in FIG. 2, when tower 100 is installed offshore, each chamber 126, 127, 128 is disposed below the sea surface 103, and chamber 129 extends through the sea surface 103 to topside 150. Although column 120 includes four chambers 126, 127, 128, 129 in this embodiment, in general, each column (e.g., each column 120) may include any suitable number of chambers. Preferably, at least one chamber is a ballast adjustable chamber and one chamber is an empty buoyant chamber (i.e., filled with air). As will be described in more detail below, in other embodiments, the ballast adjustable chamber and the fixed ballast chamber may be combined into a single chamber that holds fixed ballast, water, air, or combinations thereof. Further, although end caps 123 and bulkheads 124 are described as providing fluid tight seals at the ends of chambers 126, 127, 128, 129, it should be appreciated that one or more end caps 123 and/or bulkheads 124 may include a closeable and sealable access port (e.g., man hole cover) that allows controlled access to one or more chambers 126, 127, 128, 129 for maintenance, repair, and/or service.

Figure 5:
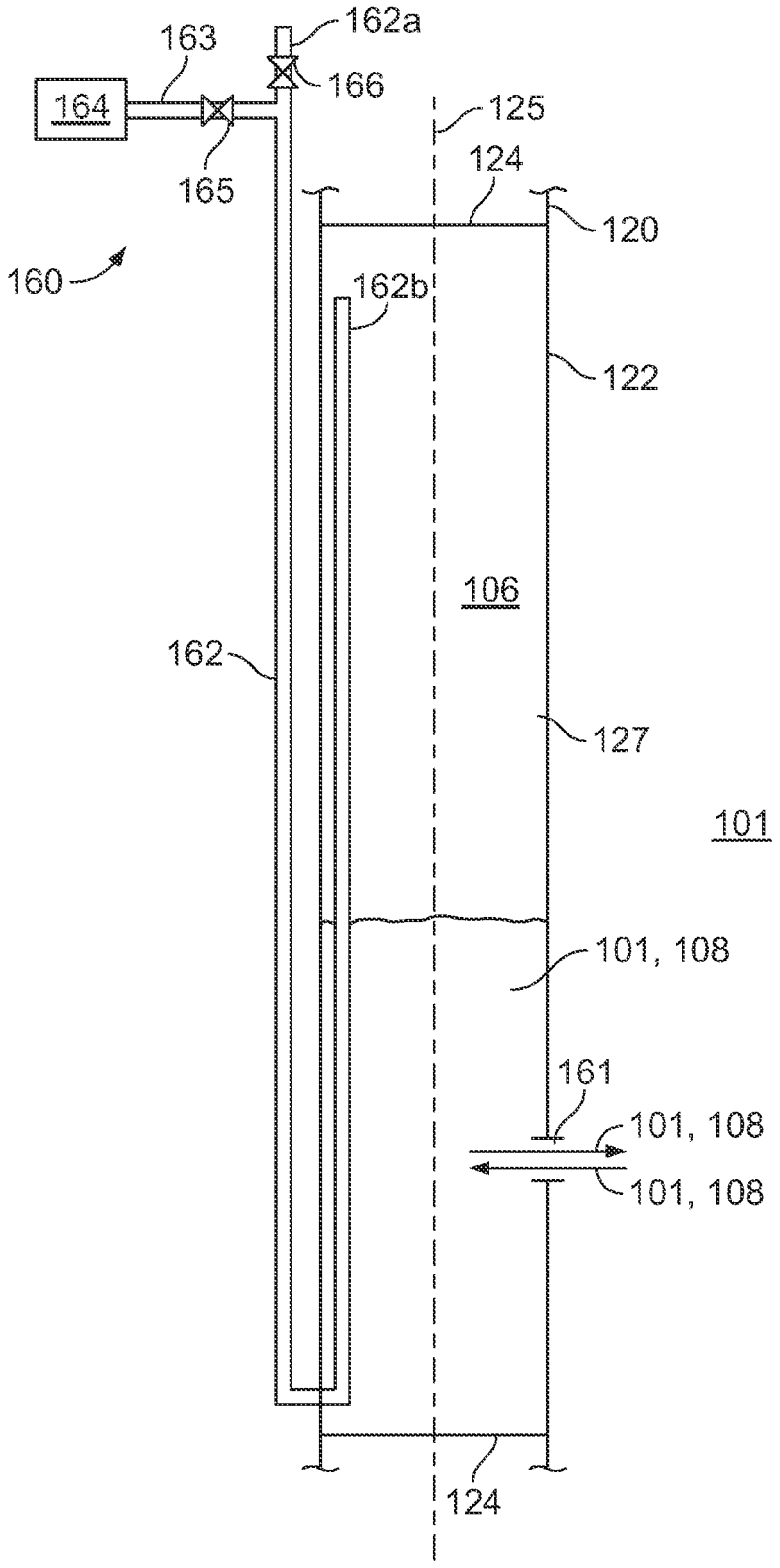
FIG. 5 is an enlarged schematic view of the ballast adjustable chamber of the outer column of FIG. 4.

Referring now to FIG. 5, one ballast adjustable chamber 127 is schematically shown, it being understood that each ballast adjustable chamber 127 of each column 120 is configured the same. Unlike sealed buoyant chambers 128, 129 previously described, chamber 127 is ballast adjustable. In this embodiment, a ballast control system 160 and a port 161 enable adjustment of the volume of ballast 108 in chamber 127. More specifically, port 161 is an opening or hole in tubular 122 axially disposed between the upper and lower axial ends of chamber 127. As previously described, when tower 100 is installed offshore, chamber 127 is submerged in the water 101, and thus, port 161 allows water 101, 108 to move into and out of chamber 127. It should be appreciated that flow through port 161 is not controlled by a valve or other flow control device. Thus, port 161 permits the free flow of water 101, 108 into and out of chamber 127.

Ballast control system 160 includes an air conduit 162, an air supply line 163, an air compressor or pump 164 connected to supply line 163, a first valve 165 along line 163 and a second valve 166 along conduit 162. Conduit 162 extends subsea into chamber 127, and has a venting end 162*a* above the sea surface 103 external chamber 127 and an open end 162*b* disposed within chamber 127. Valve 166 controls the flow of air 106 through conduit 162 between ends 162*a, b*, and valve 165 controls the flow of air 106 from compressor 164 to chamber 127. Control system 160 allows the relative volumes of air 106 and water 101, 108 in chamber 127 to be controlled and varied, thereby enabling the buoyancy of chamber 127 and associated column 120 to be controlled and varied. In particular, with valve 166 open and valve 165 closed, air 106 is exhausted from chamber 127, and with valve 165 open and valve 166 closed, air 106 is pumped from compressor 164 into chamber 127. Thus, end 162*a* functions as an air outlet, whereas end 162*b* functions as both an air inlet and outlet. With valve 165 closed, air 106 cannot be pumped into chamber 127, and with valves 165, 166 closed, air 106 cannot be exhausted from chamber 127.

In this embodiment, open end 162*b* is disposed proximal the upper end of chamber 127 and port 161 is positioned proximal the lower end of chamber 127. This positioning of open end 162*b* enables air 106 to be exhausted from chamber 127 when column is in a generally vertical, upright position (e.g., following installation). In particular, since buoyancy control air 106 (e.g., air) is less dense than water 101, any buoyancy control air 106 in chamber 127 will naturally rise to the upper portion of chamber 127 above any water 101, 108 in chamber 127 when column 120 is upright. Accordingly, positioning end 162*b* at or proximal the upper end of chamber 127 allows direct access to any air 106 therein. Further, since water 101, 108 in chamber 127 will be disposed below any air 106 therein, positioning port 161 proximal the lower end of chamber 127 allows ingress and egress of water 101, 108, while limiting and/or preventing the loss of any air 106 through port 161. In general, air 106 will only exit chamber 127 through port 161 when chamber 127 is filled with air 106 from the upper end of chamber 127 to port 161. Positioning of port 161 proximal the lower end of chamber 127 also enables a sufficient volume of air 106 to be pumped into chamber 127. In particular, as the volume of air 106 in chamber 127 is increased, the interface between water 101, 108 and the air 106 will move downward within chamber 127 as the increased volume of air 106 in chamber 127 displaces water 101, 108 in chamber 127, which is allowed to exit chamber through port 161. However, once the interface of water 101, 108 and the air 106 reaches port 161, the volume of air 106 in chamber 127 cannot be increased further as any additional air 106 will simply exit chamber 127 through port 161. Thus, the closer port 161 to the lower end of chamber 127, the greater the volume of air 106 that can be pumped into chamber 127, and the further port 161 from the lower end of chamber 127, the lesser the volume of air 106 that can be pumped into chamber 127. Thus, the axial position of port 161 along chamber 127 is preferably selected to enable the maximum desired buoyancy for chamber 127.

In this embodiment, conduit 162 extends through tubular 122. However, in general, the conduit (e.g., conduit 162) and the port (e.g., port 161) may extend through other portions of the column (e.g., column 120). For example, the conduit may extend axially through the column (e.g., through cap 123 at upper end 120*a* and bulkheads 124) in route to the ballast adjustable chamber (e.g., chamber 127). Any passages (e.g., ports, etc.) extending through a bulkhead or cap are preferably completely sealed.

Without being limited by this or any particular theory, the flow of water 101, 108 through port 161 will depend on the depth of chamber 127 and associated hydrostatic pressure of water 101 at that depth, and the pressure of air 106 in chamber 127 (if any). If the pressure of air 106 is less than the pressure of water 101, 108 in chamber 127, then the air 106 will be compressed and additional water 101, 108 will flow into chamber 127 through port 161. However, if the pressure of air 106 in chamber 127 is greater than the pressure of water 101, 108 in chamber 127, then the air 106 will expand and push water 101, 108 out of chamber 127 through port 161. Thus, air 106 within chamber 127 will compress and expand based on any pressure differential between the air 106 and water 101, 108 in chamber 127.

In this embodiment, conduit 162 has been described as supplying air 106 to chamber 127 and venting air 106 from chamber 127. However, if conduit 162 is exclusively filled with air 106 at all times, a subsea crack or puncture in conduit 162 may result in the compressed air 106 in chamber 127 uncontrollably venting through the crack or puncture in conduit 162, thereby decreasing the buoyancy of column 120 and potentially impacting the overall stability of structure 100. Consequently, when air 106 is not intentionally being pumped into chamber 127 or vented from chamber 127 through valve 166 and end 162*b*, conduit 162 may be filled with water up to end 162*b*. Such a column of water in conduit 162 is pressure balanced with the compressed air 106 in chamber 127. Without being limited by this or any particular theory, the hydrostatic pressure of the column of water in conduit 162 will be the same or substantially the same as the hydrostatic pressure of water 101, 108 at port 161 and in chamber 127. As previously described, the hydrostatic pressure of water 101, 108 in chamber 127 is balanced by the pressure of air 106 in chamber 127. Thus, the hydrostatic pressure of the column of water in conduit 162 is also balanced by the pressure of air 106 in chamber 127. If the pressure of air 106 in chamber 127 is less than the hydrostatic pressure of the water in conduit 162, and hence, less than the hydrostatic pressure of water 101 at port 161, then the air 106 will be compressed, the height of the column of water in conduit 162 lengthen, and water 101 will flow into chamber 127 through port 161. However, if the pressure of air 106 in chamber 127 is greater than the hydrostatic pressure of the water in conduit 162, and hence, greater than the hydrostatic pressure of water 101 at port 161, then the air 106 will expand and push water 101, 108 out of chamber 127 through port 161 and push the column of water in conduit 162 upward. Thus, when water is in conduit 162, it functions similar to a U-tube manometer. In addition, the hydrostatic pressure of the column of water in conduit 162 is the same or substantially the same as the water 101 surrounding conduit 162 at a given depth. Thus, a crack or puncture in conduit 162 placing the water within conduit 162 in fluid communication with water 101 outside conduit 162 will not result in a net influx or outflux of water within conduit 162, and thus, will not upset the height of the column of water in conduit 162. Since the height of the water column in conduit 162 will remain the same, even in the event of a subsea crack or puncture in conduit 162, the balance of the hydrostatic pressure of the water column in conduit 162 with the air 106 in chamber 127 is maintained, thereby restricting and/or preventing the air 106 in chamber 127 from venting through conduit 162. To remove the water from conduit 162 to controllably supply air 106 to chamber 127 or vent air 106 from chamber 127 via conduit 162, the water in conduit 162 may simply be blown out into chamber 127 by pumping air 106 down conduit 162 via pump 164, or alternatively, a water pump may be used to pump the water out of conduit 162.

Referring again to FIG. 4, fixed ballast chamber 126 is disposed at lower end 120*b* of column 120. In this embodiment, fixed ballast 107 (e.g., water, iron ore, etc.) is pumped into chamber 126 with a ballast pump 180 and a ballast supply flowline or conduit 181 extending subsea to chamber 126. A valve 182 disposed along conduit 181 is opened to pump fixed ballast 107 into chamber 126. Otherwise, valve 182 is closed (e.g., prior to and after filling chamber 126 with fixed ballast 107). In other embodiments, the fixed ballast chamber (e.g., chamber 126) may simply include a port that allows water (e.g., water 101) to flood the fixed ballast chamber once it is submerged subsea.

Although ballast adjustable chamber 127 and fixed ballast chamber 126 are distinct and separate chambers in column 120 in this embodiment, in other embodiments, a separate fixed ballast chamber (e.g., chamber 126) may not be included. In such embodiments, the fixed ballast (e.g., fixed ballast 107) may simply be disposed in the lower end of the ballast adjustable chamber (e.g., chamber 127). The ballast control system (e.g., system 160) may be used to supply air (air 106), vent air, and supply fixed ballast (e.g., iron ore pellets or granules) to the ballast adjustable chamber, or alternatively, a separate system may be used to supply the fixed ballast to the ballast adjustable chamber. It should be appreciated that the higher density fixed ballast will settle out and remain in the bottom of the ballast adjustable chamber, while water and air are moved into and out of the ballast adjustable chamber during ballasting and deballasting operations.

Referring again to FIGS. 2 and 3, center column 130 has a central or longitudinal axis 135 coaxially aligned with axis 115, a first or upper end 130*a*, and a second or lower end 130*b* opposite end 130*a*. Lower end 130*b* defines the lower end 110*b* of hull 110. An anchor 140 extends axially from lower end 130*b* of column 130. As will be described in more detail below, anchor 140 penetrates the sea floor 102 and secures tower 100 thereto. Column 130 has a length $L_{130}$ measured axially between ends 130*a, b*, and anchor 140 has a length $L_{140}$ measured axially from end 130*b*. Further, column 130 has a diameter $D_{130}$ measured perpendicular to its corresponding axis 135 in side view (FIG. 2), and anchor 140 has a diameter $D_{140}$ measured perpendicular to axis 135 of column 130 in side view (FIG. 2). In this embodiment, the diameter $D_{140}$ of anchor 140 is equal to diameter $D_{130}$, and each diameter $D_{130}$, $D_{140}$ is greater than the diameter $D_{120}$ of each outer column 120.

In general, the length $L_{130}$ and the diameter $D_{130}$ of center column 130, as well as the length $L_{140}$ and diameter $D_{140}$ of anchor 140, may be tailored to the particular installation location and associated water depth. For most installation locations having water depths of 200 to 600 ft., the length $L_{130}$ of column 130 is preferably between 150 and 500 ft., the length $L_{140}$ of anchor 140 is preferably between 20 and 50 ft., and more preferably about 30 ft., and each diameter $D_{130}$, $D_{140}$ is preferably between 15 ft. and 50 ft., and more preferably about 20 ft. However, depending on the particular installation location and desired dynamic behavior of tower 100 under environmental loads, each length $L_{130}$, $L_{140}$ and each diameter $D_{130}$, $D_{140}$ may be varied and adjusted as appropriate.

In general, the geometry of a subsea anchor or pile may be described in terms of an "aspect ratio." As used herein, the term "aspect ratio" refers to the ratio of the length of an anchor or pile measured axially along its longitudinal axis to the diameter or maximum width of the anchor or pile measured perpendicular to its longitudinal axis. Thus, anchor 140 has an aspect ratio equal to the ratio of the length $L_{140}$ of anchor 140 to the diameter $D_{140}$ of anchor 140. In embodiments described herein, the aspect ratio of anchor 140 is preferably less than 3:1, and more preferably greater than or equal to 1:1 and less than or equal to 2:1. Such preferred aspect ratios enable anchor 140 to provide a sufficient load bearing capacity and a sufficient lateral load capacity to secure tower 100 to the sea floor 102 and maintain the position of tower 100 at the installation site, while allowing tower 100 to pivot relative to the sea floor 102 as will be described in more detail below.

Figure 6:
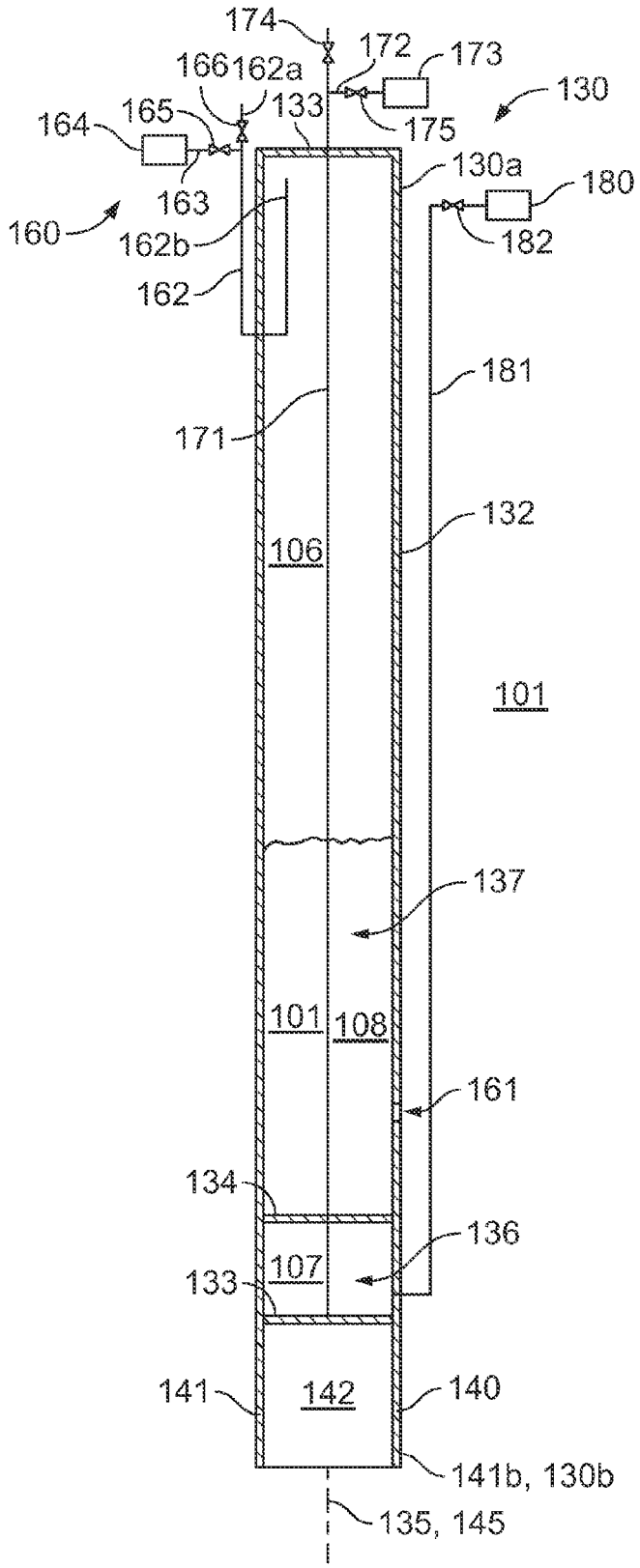
FIG. 6 is a cross-sectional view of the center column of the hull of FIG. 2.

Referring now to FIG. 6, center column 130 and associated anchor 140 are schematically shown. In this embodiment, column 130 comprises a radially outer tubular 132 extending between ends 130*a, b*, upper and lower end walls or caps 133 at ends 130*a, b*, respectively, and a bulkhead 134 positioned within tubular 132 between ends 130*a, b*. End caps 133 and bulkhead 134 are each oriented perpendicular to axis 135. Together, tubular 132, end walls 133, and bulkhead 134 define a plurality of axially stacked compartments or cells within column 130—a fixed ballast chamber 136 at lower end 130*b* and a variable ballast or ballast adjustable chamber 137 extending axially from chamber 136 to end 130*a*. In this embodiment, center column 130 does not include any buoyancy chambers filled with air and sealed from the surrounding environment. Each chamber 136, 137 has a length $L_{136}$, $L_{137}$, respectively, measured axially between its axial ends. The length $L_{136}$ is preferably less than length $L_{137}$, with the length $L_{137}$ preferably being the difference between length $L_{130}$ of center column 130 and length $L_{136}$. In particular, length $L_{136}$ is preferably between 5 and 30 ft., and length $L_{137}$ is preferably between 20 and 200 ft. However, depending on the particular installation location and desired dynamic behavior of tower 100 under environmental loads, each length $L_{136}$, $L_{137}$ may be varied and adjusted as appropriate.

End caps 133 close off ends 130*a, b* of column 130, thereby preventing fluid flow through ends 130*a, b* into chambers 136, 137, respectively. Bulkhead 134 prevents fluid communication between adjacent chambers 136, 137. Thus, each chamber 136, 137 is isolated from the other chamber 136, 137 in column 120.

As will be described in more detail below, during offshore transport of hull 110, fixed ballast chamber 136 and variable ballast chamber 137 are filled with air 106, thereby contributing to the buoyancy of column 130 and hull 110. However, during installation of hull 110, chamber 136 is filled with fixed ballast 107 (e.g., water, iron ore, etc.) to increase the weight of column 130, orient column 130 and hull 110 upright, and to drive anchor 140 into the sea floor 102. During offshore drilling and/or production operations with tower 100, the fixed ballast 107 in chamber 136 is generally permanent (i.e., remains in place). During installation of hull 110 at the offshore operation site, ballast 108 is controllably added to ballast adjustable chamber 137 to decrease the buoyancy of column 130, orient column 130 upright, and to drive anchor 140 into the sea floor 102. However, unlike fixed ballast chamber 136, during offshore drilling and/or production operations with tower 100, ballast 108 in chamber 137 may be controllably varied (i.e., increased or decreased), as desired, to vary the buoyancy of column 130 and hull 110. As best shown in FIG. 2, when tower 100 is installed offshore, each chamber 136, 137 is disposed below the sea surface 103.

Although center column 130 includes two chambers 136, 137 in this embodiment, in general, the center column (e.g., column 130) may include any suitable number of chambers. Further, although end caps 133 and bulkhead 134 are described as providing fluid tight seals at the ends of chambers 136, 137, it should be appreciated that one or more end caps 133 and/or bulkheads 134 may include a closeable and sealable access port (e.g., man hole cover) that allows controlled access to one or more chambers 136, 137 for maintenance, repair, and/or service.

Referring still to FIG. 6, similar to ballast chamber 127 of column 120 previously described, chamber 137 of center column 130 is ballast adjustable. In particular, a ballast control system 160 and a port 161, each as previously described, enable adjustment of the volume of variable ballast 108 in chamber 137. Namely, port 161 is an opening or hole in tubular 132 axially disposed between the upper end lower axial ends of chamber 137. As previously described, when tower 100 is installed offshore, chamber 137 is submerged in the water 101, and thus, port 161 allows water 101, 108 to move freely into and out of chamber 137. Ballast control system 160 includes an air conduit 162, an air supply line 163, an air compressor or pump 164 connected to supply line 163, a first valve 165 along line 163 and a second valve 166 along conduit 162. Conduit 162 extends subsea into chamber 137, and has a venting end 162*a* above the sea surface 103 external chamber 137 and an open end 162*b* disposed within chamber 137. Valve 166 controls the flow of air 106 through conduit 162 between ends 162*a, b*, and valve 165 controls the flow of air 106 from compressor 164 to chamber 137. Control system 160 allows the relative volumes of air 106 and water 101, 108 in chamber 137 to be controlled and varied, thereby enabling the buoyancy of chamber 137 and column 130 to be controlled and varied. In particular, with valve 166 open and valve 165 closed, air 106 is exhausted from chamber 137, and with valve 165 open and valve 166 closed, air 106 is pumped from compressor 164 into chamber 137. Thus, end 162*a* functions as an air outlet, whereas end 162*b* functions as both an air inlet and outlet. With valve 165 closed, air 106 cannot be pumped into chamber 137, and with valves 165, 166 closed, air 106 cannot be exhausted from chamber 137. When air 106 is not being pumped into chamber 137 or vented from chamber 137, conduit 162 may be filled with a column of water as previously described.

In this embodiment, open end 162*b* is disposed proximal the upper end of chamber 137 and port 161 is positioned proximal the lower end of chamber 137. For the same reasons as previously described, this positioning of open end 162*b* enables air 106 to be exhausted from chamber 137 when column is in a generally vertical, upright position (e.g., following installation). Further, since water 101, 108 in chamber 137 will be disposed below any air 106 therein, positioning port 161 proximal the lower end of chamber 137 allows ingress and egress of water 101, 108, while limiting and/or preventing the loss of any air 106 through port 161. Positioning of port 161 proximal the lower end of chamber 137 also enables a sufficient volume of air 106 to be pumped into chamber 137—the closer port 161 to the lower end of chamber 137, the greater the volume of air 106 that can be pumped into chamber 137, and the further port 161 from the lower end of port 137, the lesser the volume of air 106 that can be pumped into chamber 137. Thus, the axial position of port 161 along chamber 127 is preferably selected to enable the maximum desired buoyancy for chamber 137.

In this embodiment, conduit 162 extends through tubular 132. However, in general, the conduit (e.g., conduit 162) and the port (e.g., port 161) may extend through other portions of the column (e.g., column 130). For example, the conduit may extend axially through the column (e.g., through cap 133 at upper end 130*a* and bulkhead 134) in route to the ballast adjustable chamber (e.g., chamber 137). Any passages (e.g., ports, etc.) extending through a bulkhead or cap are preferably completely sealed.

Referring still to FIG. 6, fixed ballast chamber 136 is disposed at lower end 130*b* of center column 130. In this embodiment, fixed ballast 107 (e.g., water, iron ore, etc.) is pumped into chamber 136 with a ballast pump 180 and a ballast supply flowline or conduit 181, each as previously described. A valve 182 disposed along conduit 181 is opened to pump fixed ballast 107 into chamber 136. Otherwise, valve 182 is closed (e.g., prior to and after filling chamber 136 with fixed ballast 107). In other embodiments, the fixed ballast chamber (e.g., chamber 136) may simply include a port that allows water (e.g., water 101) to flood the fixed ballast chamber once it is submerged subsea.

Although ballast adjustable chamber 137 and fixed ballast chamber 136 are distinct and separate chambers in column 130 in this embodiment, in other embodiments, a separate fixed ballast chamber (e.g., chamber 136) may not be included. In such embodiments, the fixed ballast (e.g., fixed ballast 107) may simply be disposed in the lower end of the ballast adjustable chamber (e.g., chamber 137). The ballast control system (e.g., system 160) may be used to supply air (air 106), vent air, and supply fixed ballast (e.g., iron ore pellets or granules) to the ballast adjustable chamber, or alternatively, a separate system may be used to supply the fixed ballast to the ballast adjustable chamber. It should be appreciated that the higher density fixed ballast will settle out and remain in the bottom of the ballast adjustable chamber, while water and air are moved into and out of the ballast adjustable chamber during ballasting and deballasting operations.

Referring again to FIGS. 2 and 3, tower 100 has a center of buoyancy 105 and a center of gravity 106 with center column 130 in the fully extended position, and a center of buoyancy 105' and a center of gravity 106' with center column 130 in the fully retracted position. Due to the location of (a) fixed ballast in chambers 126, 136 at lower ends 120*b*, 130*b*, (b) variable ballast in the lower portions of chambers 127, 137 adjacent chambers 126, 136, and (c) the air in buoyancy chambers 128, 129 proximal upper ends 120*a* and air in the upper portions of chambers 127, 137 adjacent chambers 128, 129, center of buoyancy 105, 105' is positioned axially above center of gravity 106, 106', respectively. As will be described in more detail below, this arrangement offers the potential to enhance the stability of tower 100 when it is in a generally vertical, upright position, whether center column 130 is extended or refracted.

Figure 7:
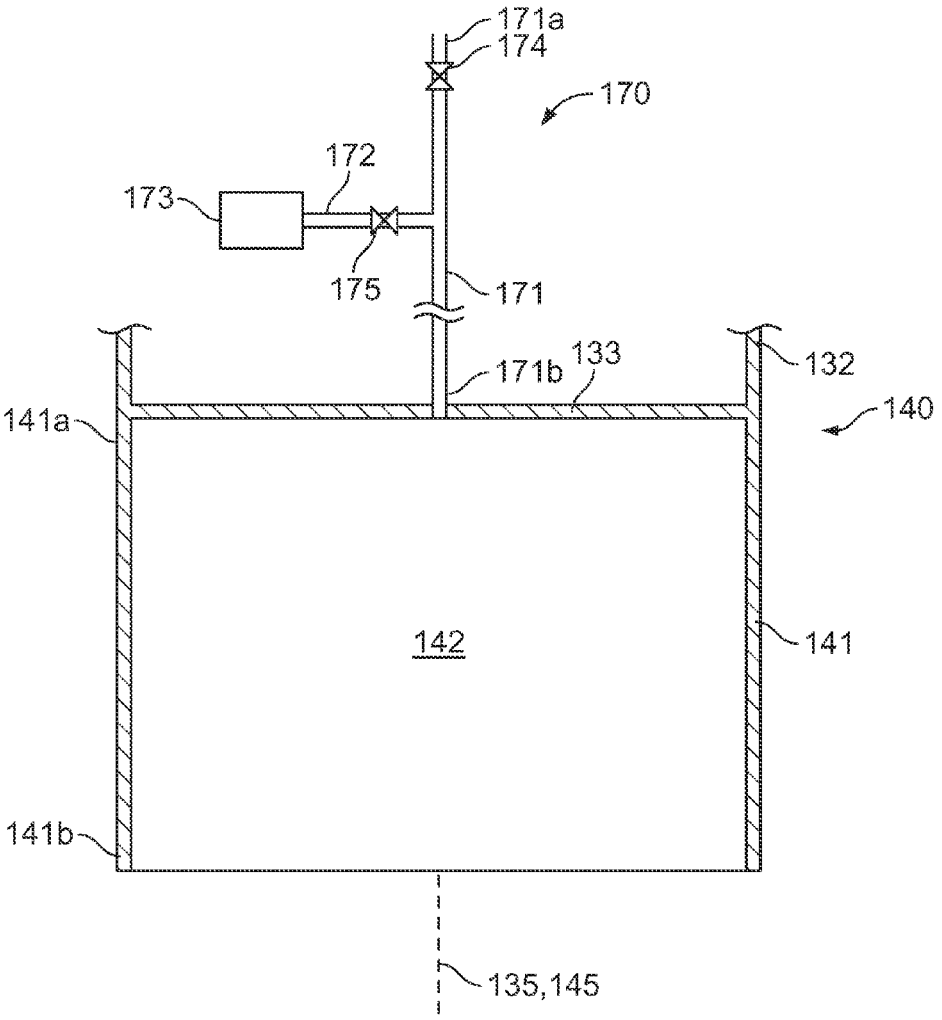
FIG. 7 is an enlarged cross-sectional view of the anchor of FIG. 6.

Referring now to FIGS. 6 and 7, anchor 140 extends axially from lower end 130*b* of center column 130. In this embodiment, anchor 140 is a suction pile comprising an annular, cylindrical skirt 141 having a central axis 145 coaxially aligned with axis 135, a first or upper end 141*a* secured to tubular 132 at lower end 130*b*, a second or lower end 141*b* distal column 130, and a cylindrical cavity 142 extending axially between ends 141*a, b*. Cavity 142 is closed off and isolated from axially adjacent chamber 136 by cap 133, however, cavity 142 is completely open to the surrounding environment at lower end 141*a*.

As will be described in more detail below, anchor 140 is employed to secure column 130, hull 110, and tower 100 to the sea floor 102. During installation of hull 110, skirt 141 is urged axially downward into the sea floor 102, and during removal of hull 110 from the sea floor 102 for transport to a different offshore location, skirt 141 is pulled axially upward from the sea floor 102. To facilitate the insertion and removal of anchor 140 into and from the sea floor 102, this embodiment includes a suction/injection control system 170.

Referring still to FIGS. 6 and 7, system 170 includes a main flowline or conduit 171, a fluid supply/suction line 172 extending from main conduit 171, and an injection/suction pump 173 connected to line 172. Conduit 171 extends subsea to cavity 142, and has an upper venting end 171*a* and a lower open end 171*b* in fluid communication with cavity 142. A valve 174 is disposed along conduit 171 controls the flow of fluid (e.g., mud, water, etc.) through conduit 171 between ends 171*a, b*—when valve 174 is open, fluid is free to flow through conduit 171 from cavity 142 to venting end 171*a*, and when valve 174 is closed, fluid is restricted and/or prevented from flowing through conduit 171 from cavity 142 to venting end 171*a*.

Pump 173 is configured to pump fluid (e.g., water 101) into cavity 142 and pump fluid (e.g., water 101, mud, silt, etc.) from cavity 142 via line 172 and conduit 171. A valve 175 is disposed along line 172 and controls the flow of fluid through line 172—when valve 175 is open, pump 173 may pump fluid into cavity 142 via line 172 and conduit 171, or pump fluid from cavity 142 via conduit 171 and line 172; and when valve 175 is closed, fluid communication between pump 173 and cavity 142 is restricted and/or prevented.

In this embodiment, pump 173, line 172, and valves 174, 174 are positioned axially above column 130 and may be accessed from topside 150. To maintain isolation of chambers 136, 137, caps 133 and bulkheads 134 preferably sealingly engage conduit 171 extending therethrough. However, in general, the pump (e.g., pump 173), the suction/supply line (e.g., line 172), and valves (e.g., valve 174, 175) may be disposed at any suitable location. For example, the pumps and valves may be disposed subsea and remotely actuated. Further, in this embodiment, main conduit 171 extends through column 130 in route to anchor 140. Consequently, conduit 171 extends through caps 133 and bulkhead 134. However, in other embodiments, the main conduit (e.g., conduit 171) may be positioned external the column (e.g., extend along the outside of column 130).

Figure 8:
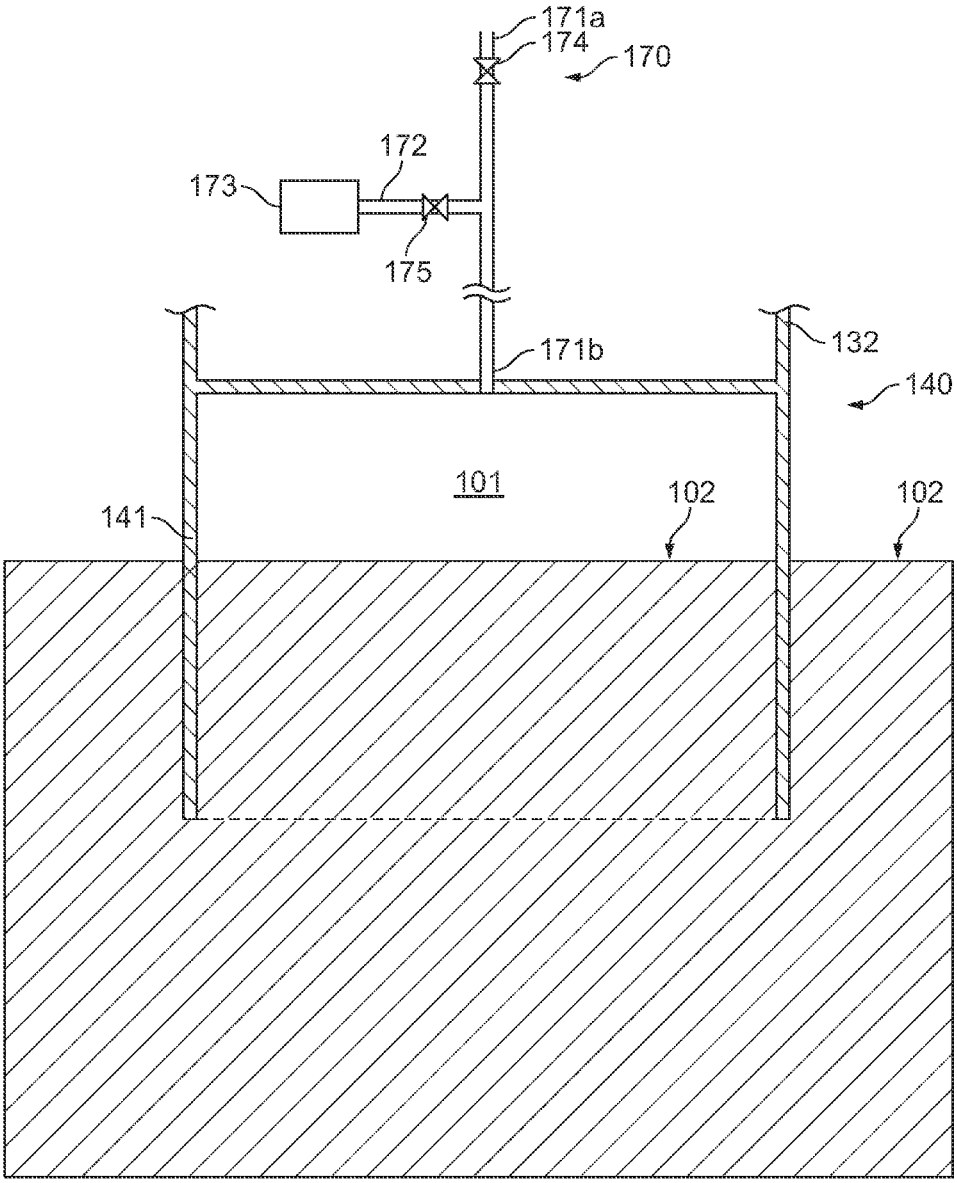
FIG. 8 is an enlarged cross-sectional view of the anchor of FIG. 6 partially penetrating the sea floor during installation or removal of the anchor.

Referring now to FIG. 8, suction/injection control system 170 may be employed to facilitate the insertion and removal of anchor 140 into and from the sea floor 102. In particular, as skirt 141 is pushed into sea floor 102, valve 174 may be opened and valve 175 closed to allow water 101 within cavity 142 between sea floor 102 and cap 123 to vent through conduit 171 and out end 171*a*. To accelerate the penetration of skirt 141 into sea floor 102 and/or to enhance the "grip" between suction skirt 141 and the sea floor 102, suction may be applied to cavity 142 via pump 173, conduit 171 and line 172. In particular, valve 175 may be opened and valve 174 closed to allow pump 173 to pull fluid (e.g., water, mud, silt, etc.) from cavity 142 through conduit 171 and line 172. Once skirt 141 has penetrated the sea floor 102 to the desired depth, valves 174, 175 are preferably closed to maintain the positive engagement and suction between anchor 140 and the sea floor 102.

To pull and remove anchor 140 from the sea floor 102 (e.g., to move tower 100 to a different location), valve 174 may be opened and valve 175 closed to vent cavity 142 and reduce the hydraulic lock between skirt 141 and the sea floor 102. To accelerate the removal of skirt 141 from sea floor 102, fluid may be pumped into cavity 142 via pump 173, conduit 171 and line 172. In particular, valve 175 may be opened and valve 174 closed to allow pump 173 to inject fluid (e.g., water) into cavity 142 through conduit 171 and line 172.

Figure 9:
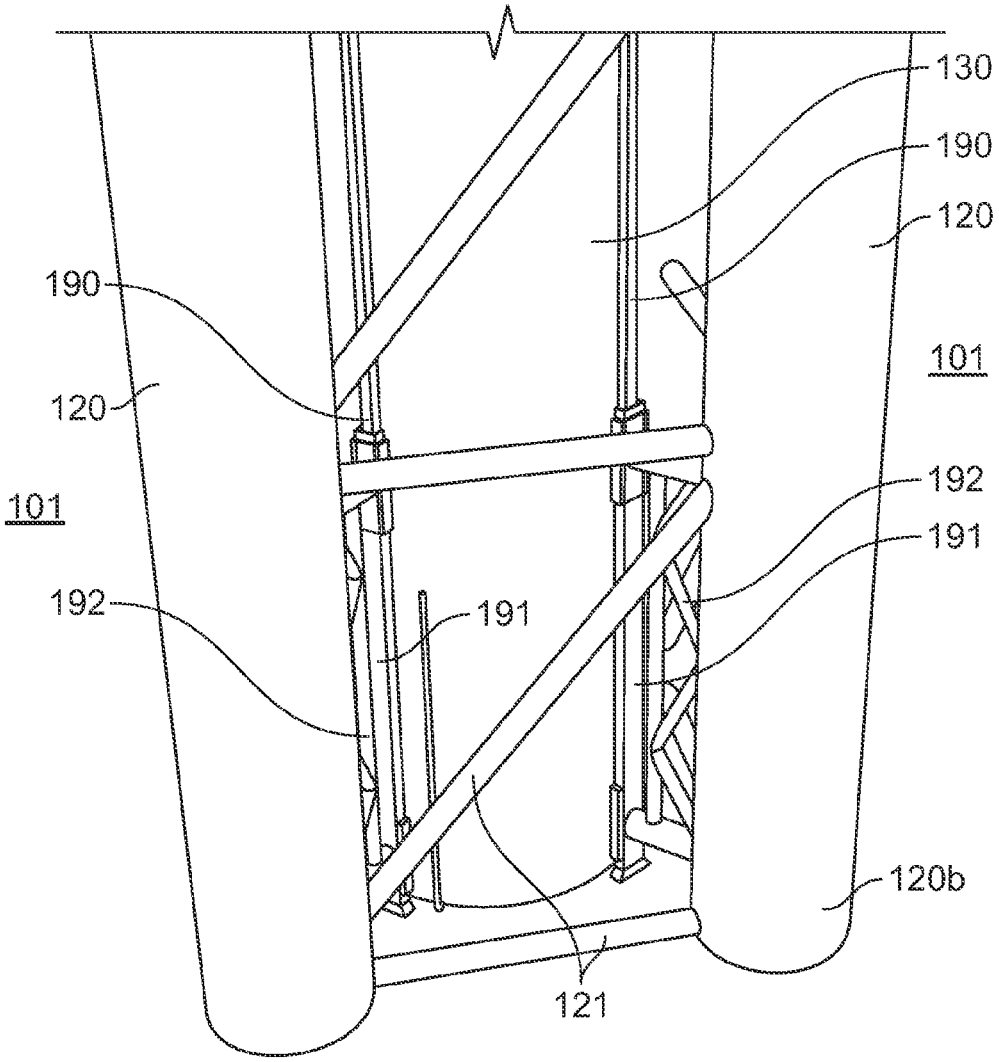
FIG. 9 is a partial perspective view of the hull of FIG. 2.

Referring now to FIG. 9, center column 130 is disposed within columns 120 and is axially moveable relative to columns 120. In this embodiment, the radially outer surface of tubular 132 includes a plurality of circumferentially spaced rails 190. Each rail 190 is oriented parallel to axis 135 and extends from upper end 130*a* to lower end 130*b* of center column 130. In addition, rails 190 are uniformly circumferentially spaced about tubular 132 such that each rail 190 is radially disposed (relative to axes 115, 135) between tubular 132 and one outer column 120. Each rail 190 is disposed within and slidingly engages a mating guide 191 coupled to the radially opposed outer column 120. In this embodiment, each guide 191 is coupled to its corresponding column 120 with a truss frame 192 extending radially inward (relative to axes 115, 135) from that column 120. Each guide 191 is oriented parallel to axes 115, 125, 135, has a lower end axially aligned with lower ends 120*b*, and an upper end positioned above lower ends 120*b*. In this embodiment, each rail 190 has a rectangular cross-section that slidingly engages a mating guide 191.

Figure 10:
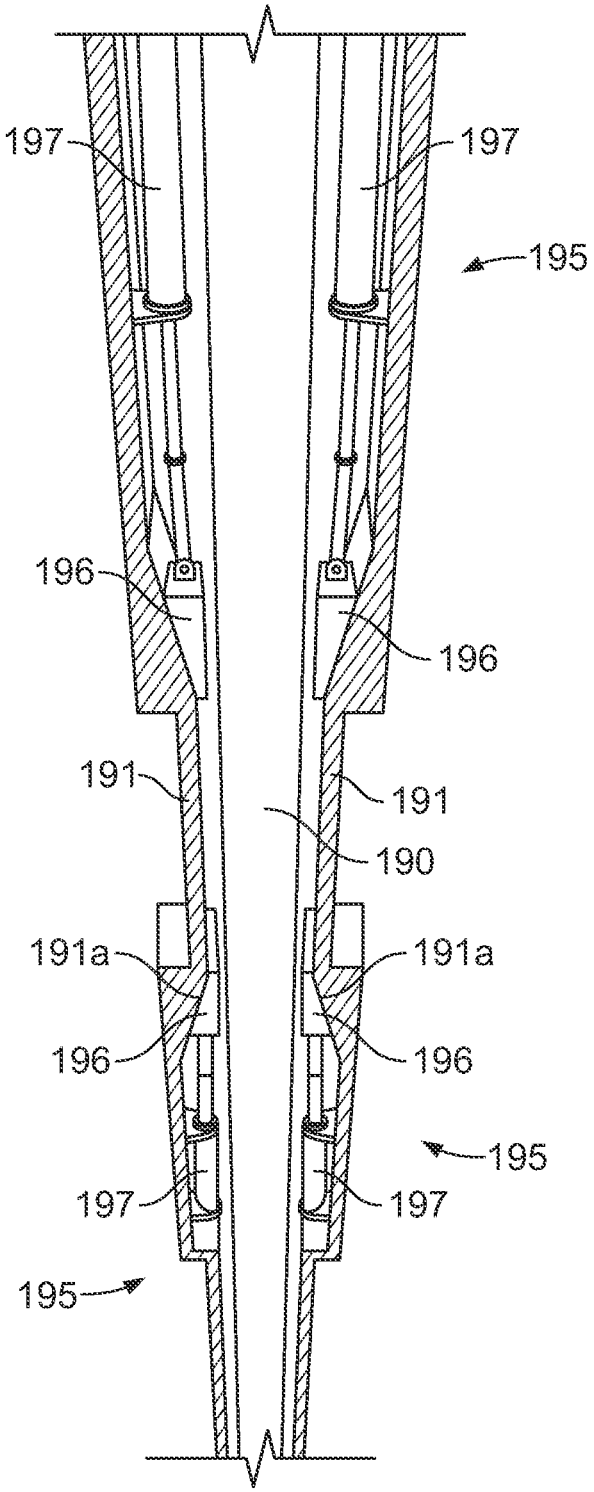
FIG. 10 is a perspective view of two locking assemblies disposed between one guide and one rail of FIG. 9.

Referring now to FIG. 10, a plurality of axially spaced locking assemblies 195 are disposed within each guide 191 and function to releasably lock the axial position of center column 130 relative to outer columns 120—each locking assembly 195 has a "locked" position restricting and/or preventing column 130 from moving axially relative to columns 120, and an "unlocked" position allowing column 130 to move axially relative to columns 120. In this embodiment, each locking assembly 195 comprises a pair of wedges 196 and a pair of linear actuators 197. The two wedges 196 in each locking assembly 195 are disposed on opposite lateral sides of a corresponding rail 190. In addition, each wedge 196 is coupled to a corresponding actuator 197. Each wedge 196 is moved linearly by its actuator 197 between an extended position and a refracted position. As each wedge 196 is transitioned to the extended position, it is cammed into engagement with rail 190 by a camming surface 191*a* on the inside of guide 191, and as each wedge 196 is transitioned to the retracted position, it is pulled out of engagement with rail 190 and guide 191. Friction between each wedge 196 and its corresponding rail 190, as well as friction between each wedge 196 and its corresponding guide 191, restricts and/or prevents rail 190 from moving relative to guide 191 when wedges 196 is in the extended position. However, when wedges 196 are in the refracted position, they do not engage the corresponding rail 190 or guide 191, and thus, rail 190 is free to move relative to guide 191.

With locking assemblies 195 in the unlocked position, center column 130 may be moved to any desired axial position relative to outer columns 120. Once column 130 is at the desired axial position, assemblies 195 may be transitioned to the locked position, thereby locking column 130 at that axial position. As will be described in more detail below, the ability to extend column 130 from columns 120 enables tower 100 to be installed at different offshore locations having different water depths.

Referring again to FIGS. 1 and 2, topside 150 is coupled to upper end 110*a* of hull 110. As will be described in more detail below, topside 150 may be transported to the offshore operational site separate from hull 110 and mounted atop hull 110 at the operational site. A lifting device 151 disposed on topside is coupled to upper end 130*a* of center column 130 and is configured to lift and lower column 130 axially relative to columns 120 when tower 100 is in the upright position. In this embodiment, device 151 is a derrick coupled to column 130 with a cable 152. However, in other embodiments, the lifting device (e.g., device 151) may be a winch or other suitable device. The various other equipment typically used in drilling and/or production operations, such as a crane, draw works, pumps, compressors, hydrocarbon processing equipment, scrubbers, precipitators and the like are disposed on and supported by topside 150.

Figure 11:
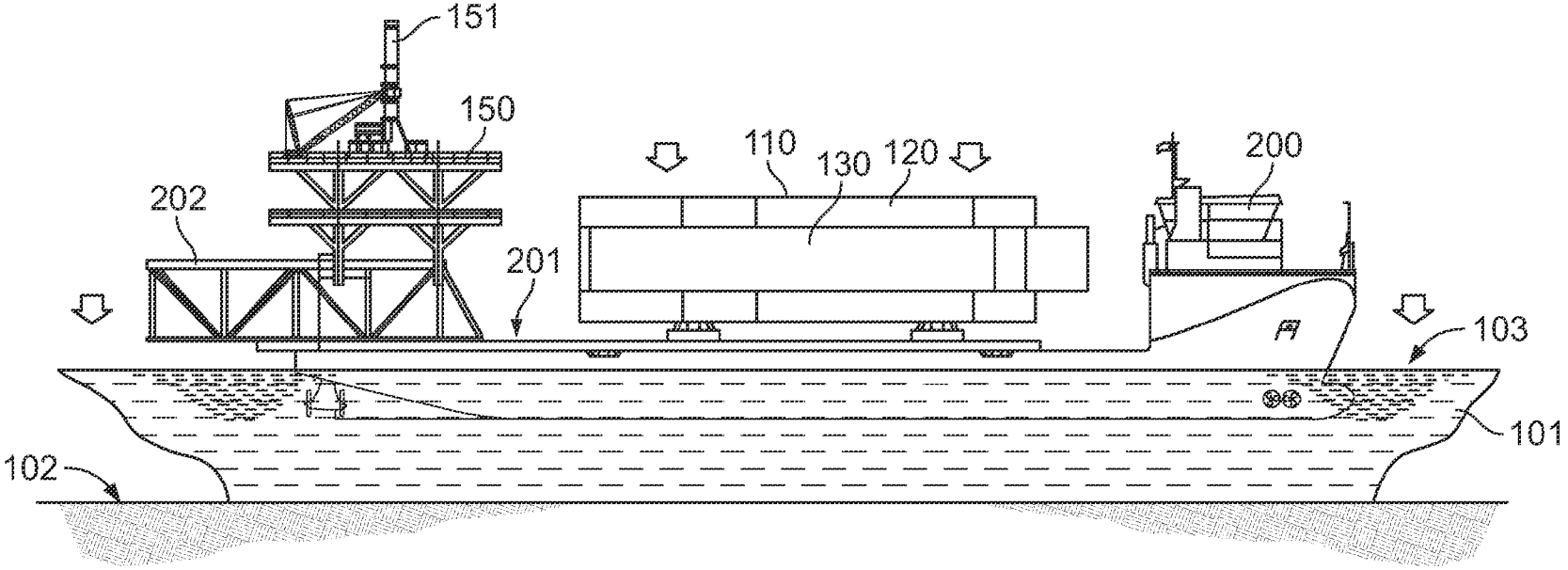
FIGS. 11-25 are schematic sequential views of the offshore deployment, transport, and installation of the tower of FIG. 1.
Figure 19:
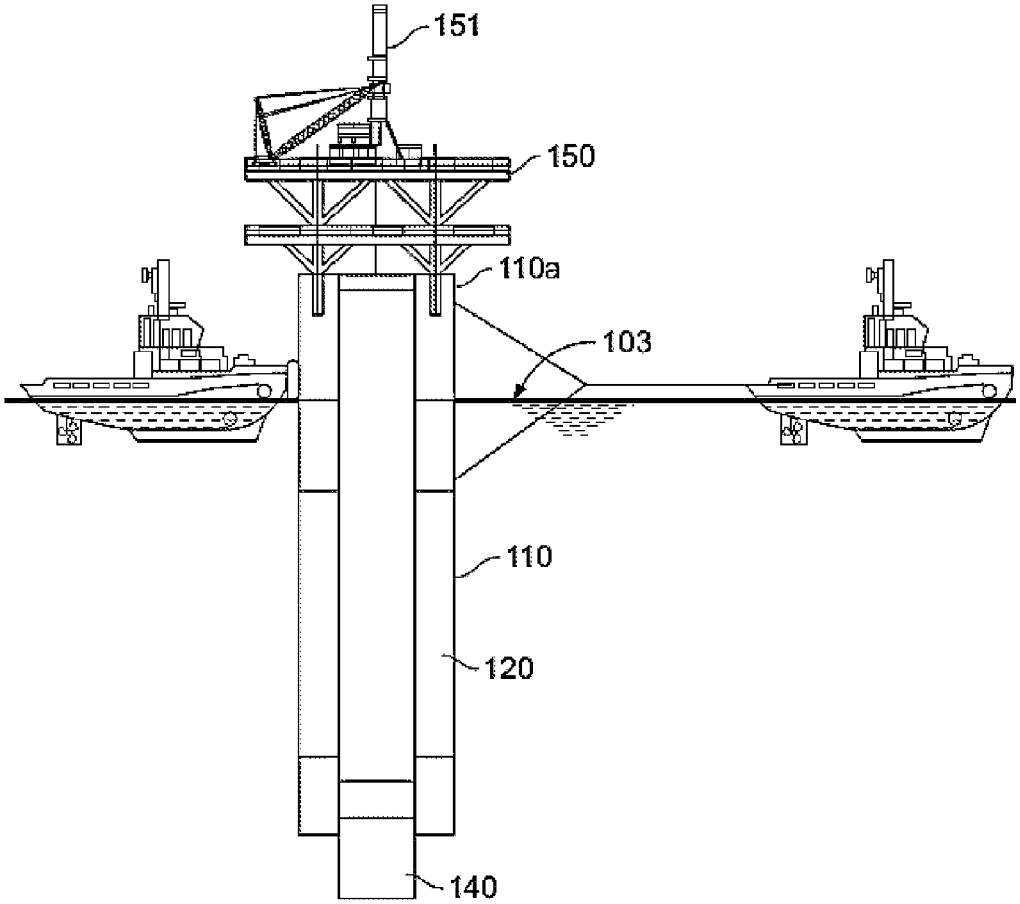
Figure 20:
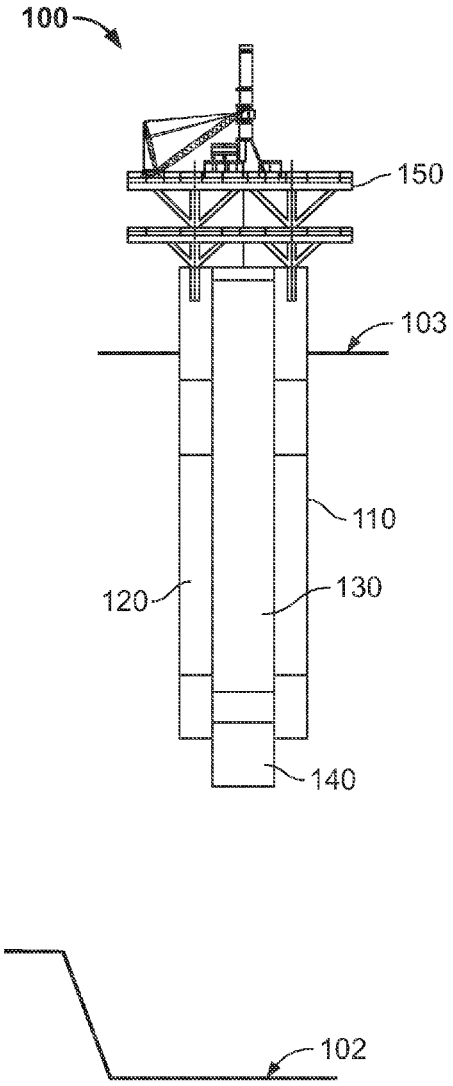
Figure 21:
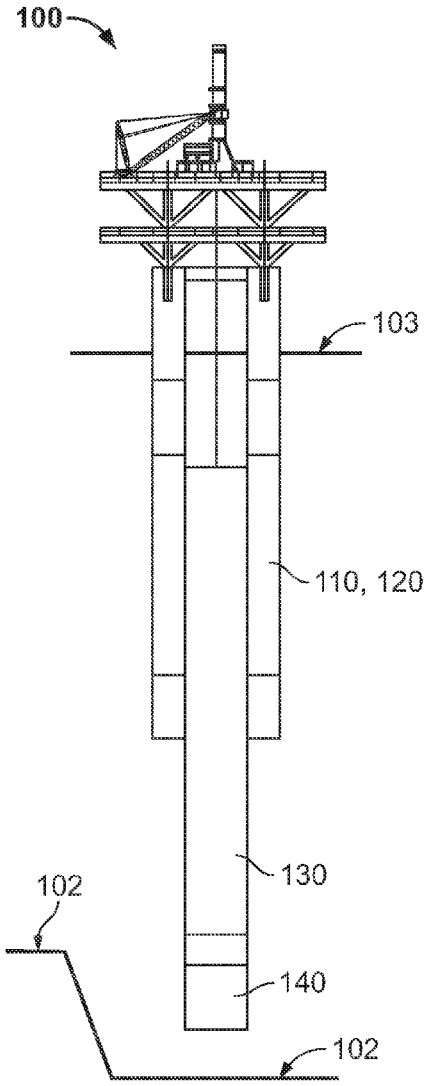
Figure 22:
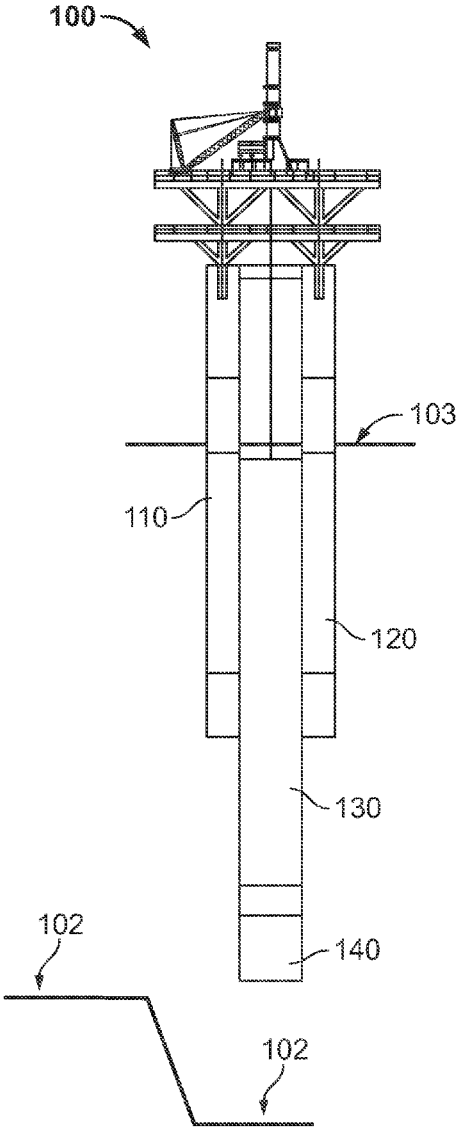

Referring now to FIGS. 11-25, the offshore deployment, transport, and installation of tower 100 is shown. In FIG. 11, hull 110 and topside 150 are shown being transported offshore on a vessel 200; in FIGS. 12-14, hull 110 is shown being offloaded from vessel 200 at an offshore location; in FIGS. 15 and 16, hull 110 is shown being transitioned from a horizontal orientation to an upright orientation; in FIGS. 17-19, topside 150 is shown being mounted to hull 110 to form tower 100; and in FIGS. 20-25, tower 100 is shown being anchored to the sea floor 102. During offshore transport and deployment of tower 100 shown in FIGS. 11-19 center column 130 is preferably fully refracted (i.e., withdrawn completely or substantially within columns 120) and locked relative to columns 120 with locking assemblies 195. However, to install and anchor of tower 100 as shown in FIGS. 20-22, locking assemblies 195 are transitioned to the unlocked position to allow column 130 to extend axially downward relative to columns 120 to the desired depth, then locking assemblies 195 are transitioned back to the locked position to fix the relative positions of columns 120, 130 prior to setting anchor 140.

Referring now to FIG. 11, hull 110 and topside 150 are separately loaded onto the deck 201 of vessel 200 for offshore transport. Hull 110 is loaded onto vessel 200 and transported offshore in a generally horizontal orientation. During loading and offshore transport of hull 110, chambers 126, 127, 128, 129, 136, 137 are completely filled with air 106, and thus, hull 110 is net buoyant. In general, hull 110 and topside 150 may be loaded onto vessel 200 in any suitable manner. For example, hull 110 and/or topside 150 may be loaded onto vessel 200 with a heave lift crane. As another example, hull 110 and/or topside 150 may be loaded onto vessel 200 by ballasting vessel 200 such that deck 201 is sufficiently submerged below the sea surface 103, positioning hull 110 and/or topside 150 over deck 201 (e.g., via floatover or a pair of barges positioned on either side of vessel 200), and then deballasting vessel 200. As vessel 200 is deballasted, deck 201 comes into engagement with hull 110 and/or topside 150, and lifts them out of the water 101. In this embodiment, hull 110 sits atop deck 201, whereas topside 150 sits atop a pair of parallel rails 202. Once hull 110 and topside 150 are loaded onto vessel 200, they may be transported to an offshore location with vessel 200.

Although hull 110 and topside 150 are shown and described as being transported offshore on the same vessel 200 in this embodiment, it should be appreciated that hull 110 and topside 150 may also be transported offshore on separate vessels (e.g., vessels 200). Further, since hull 110 is net buoyant when chambers 126, 127, 128, 129, 136, 137 are completely filled with air 106, hull 110 may also be floated out to the offshore site.

Figure 12:
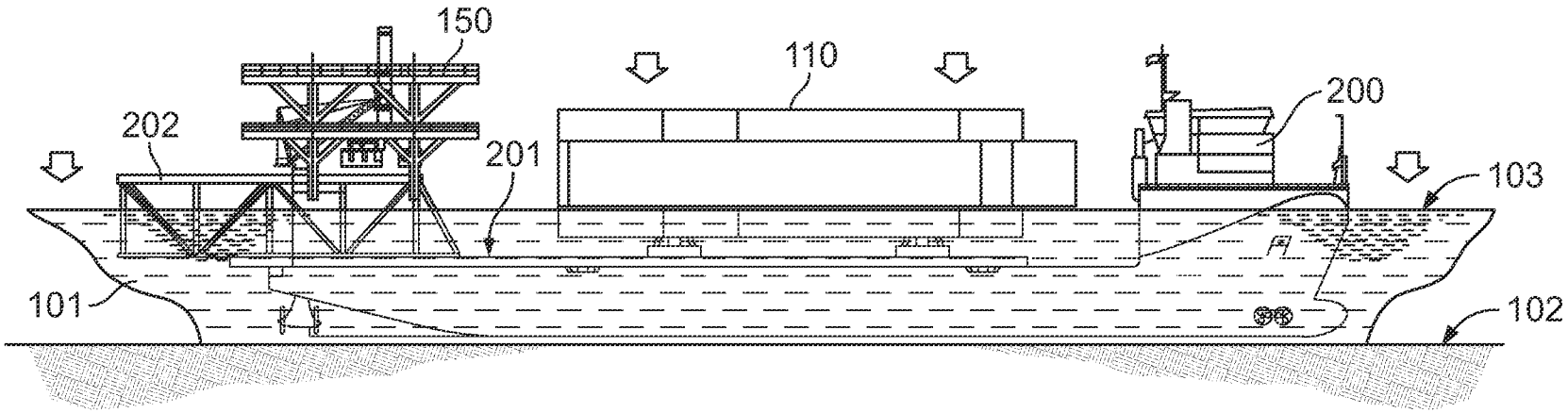
Figure 13:
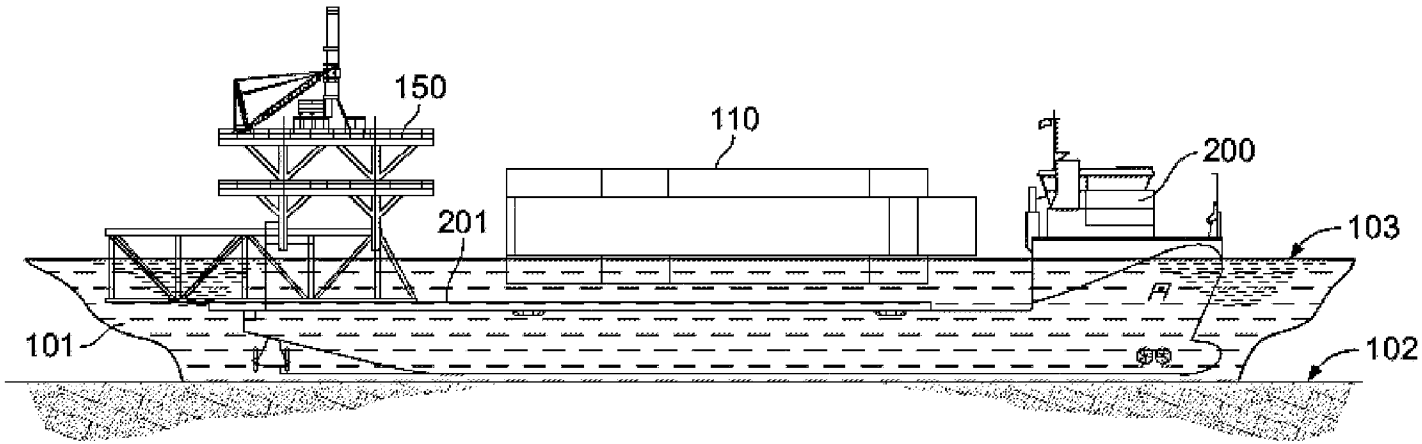
Figure 14:
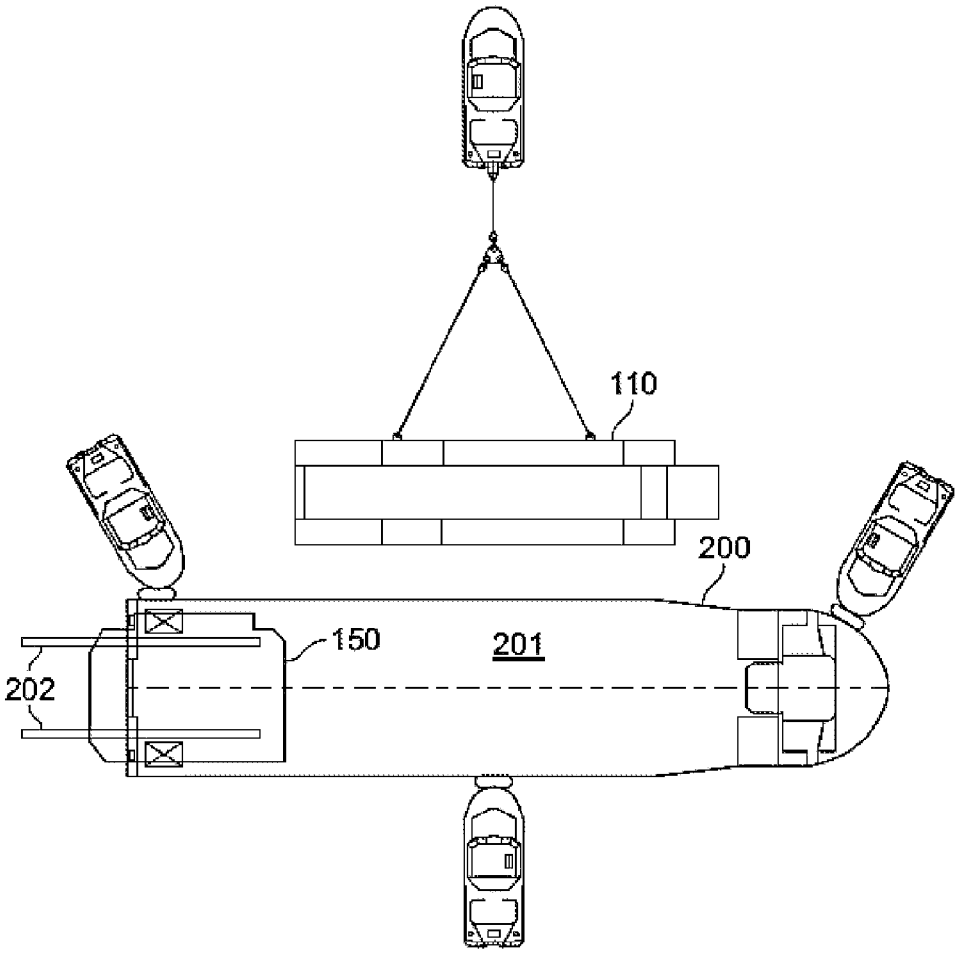

Moving now to FIGS. 12 and 13, at or near the offshore installation site, hull 110 is offloaded from vessel 200. In this embodiment, hull 110 is offloaded by ballasting vessel 200 until deck 201 is disposed sufficiently below the sea surface 103 and buoyant hull 110 floats off deck 201. Floating hull 110 is then pulled away from vessel 200 and positioned at or near the installation site in the horizontal orientation as shown in FIG. 14.

Figure 15:
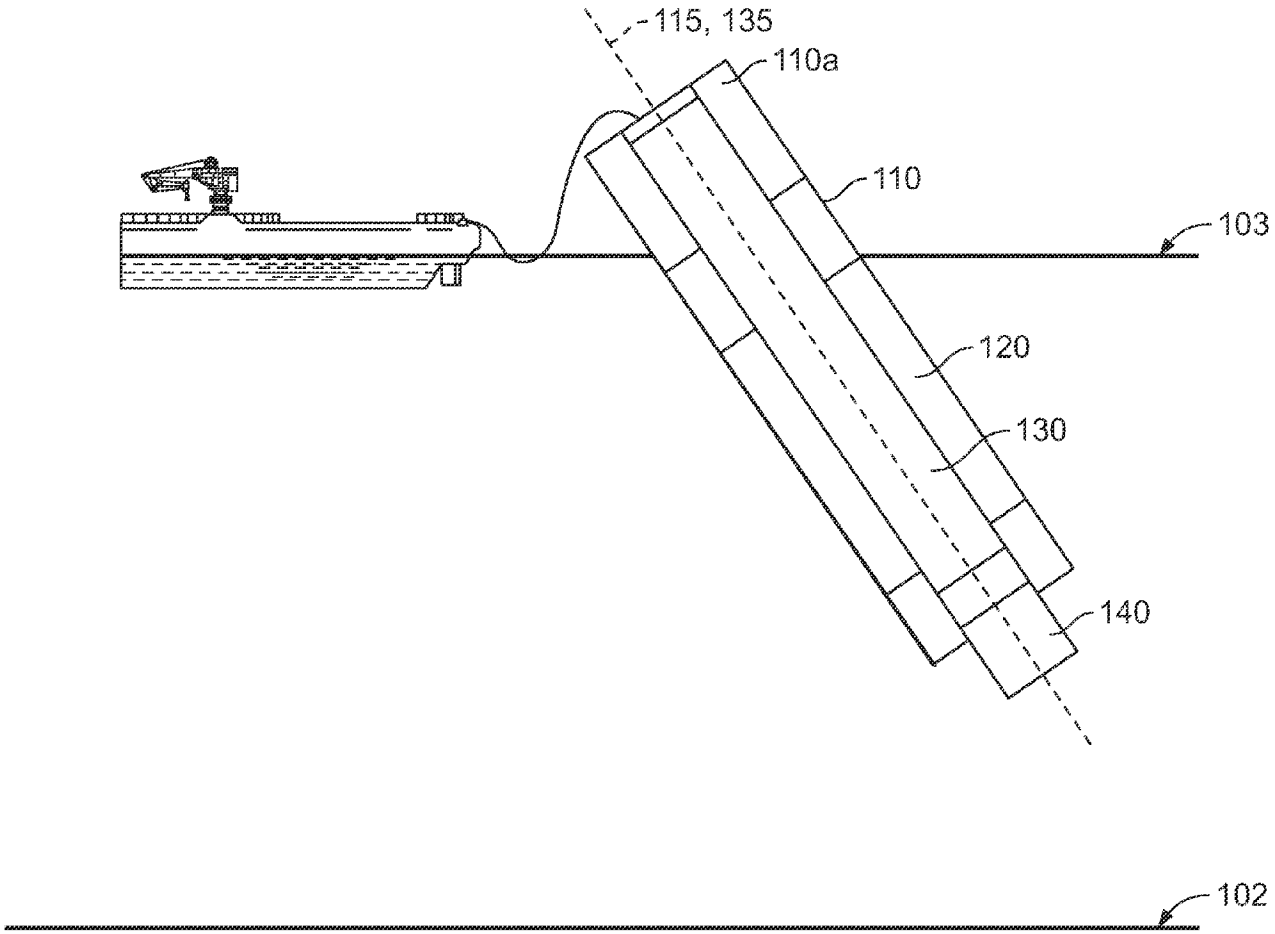
Figure 16:
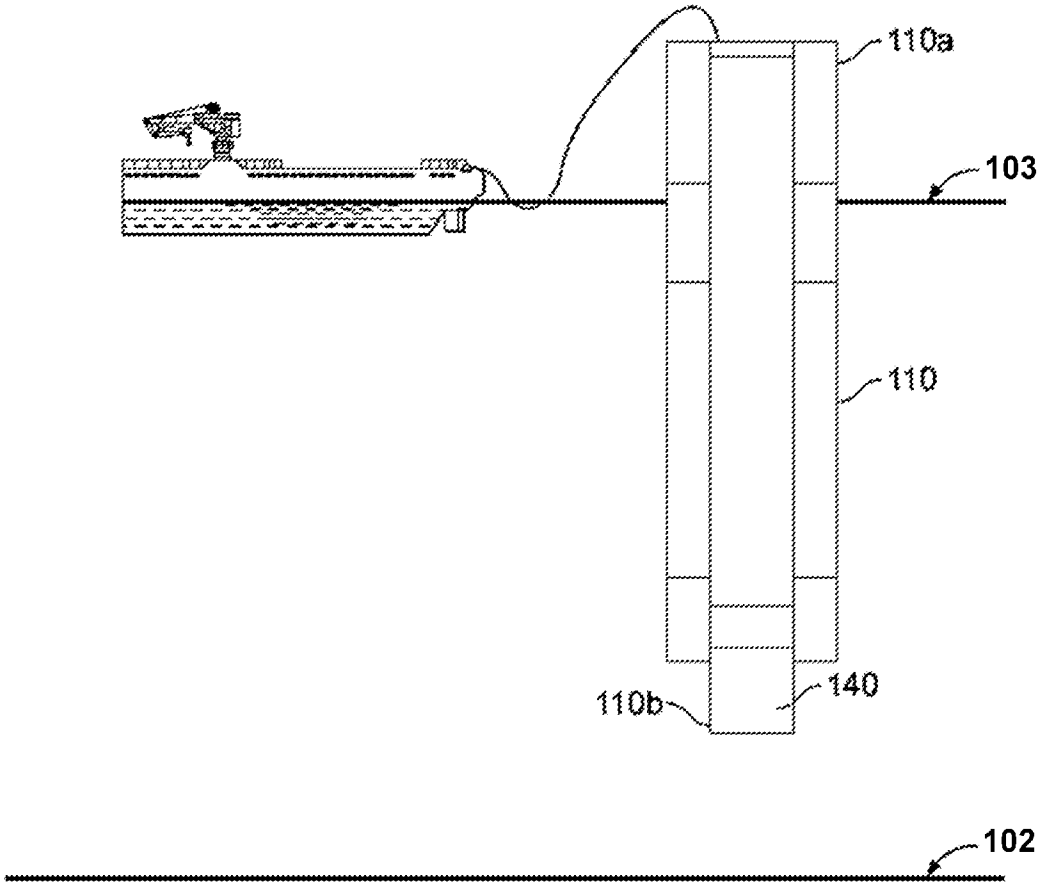

Referring now to FIGS. 15 and 16, hull 110 is transitioned from the horizontal orientation to an upright, generally vertical orientation. In particular, fixed ballast 107 is pumped into each fixed ballast chamber 126, 136 using ballast pumps 180. Since buoyant chambers 128, 129 are filled with air, sealed and disposed proximal end 120*a*, as the weight in each chamber 126, 136 increases, ends 120*b*, 130*b* of columns 120, 130, respectively, will begin to swing downward. Once ports 161 of variable ballast chambers 127, 137 become submerged below the sea surface 103, chambers 127, 137 will begin to flood with water 101, 108, thereby further facilitating the rotation of hull 110 to the upright position shown in FIG. 16. The degree of flooding of chambers 127, 137 may be enhanced by allowing air 106 in chambers 127, 137 to vent through conduits 162. The overall draft of hull 110 may be managed and adjusted using ballast control systems 160 as previously described to vary the relative volumes of air 106 and water 101, 108 in chambers 127, 137.

Air filled, sealed chambers 128, 129 enable outer columns 120 to remain net buoyant as chambers 126 fill with fixed ballast 107 and chambers 127 fill with water 101, 108. However, center column 130 does not include any air filled, sealed chambers. Thus, as chamber 136 fills with fixed ballast 107, and chamber 137 fills with water 101, 108, the weight of center column 130 may exceed the buoyancy of column 130. The transition of center column 130 from being net buoyant to non-net buoyant may be controlled by using ballast control systems 160 as previously described to vary the relative volumes of air 106 and water 101, 108 in chamber 137.

Figure 17:
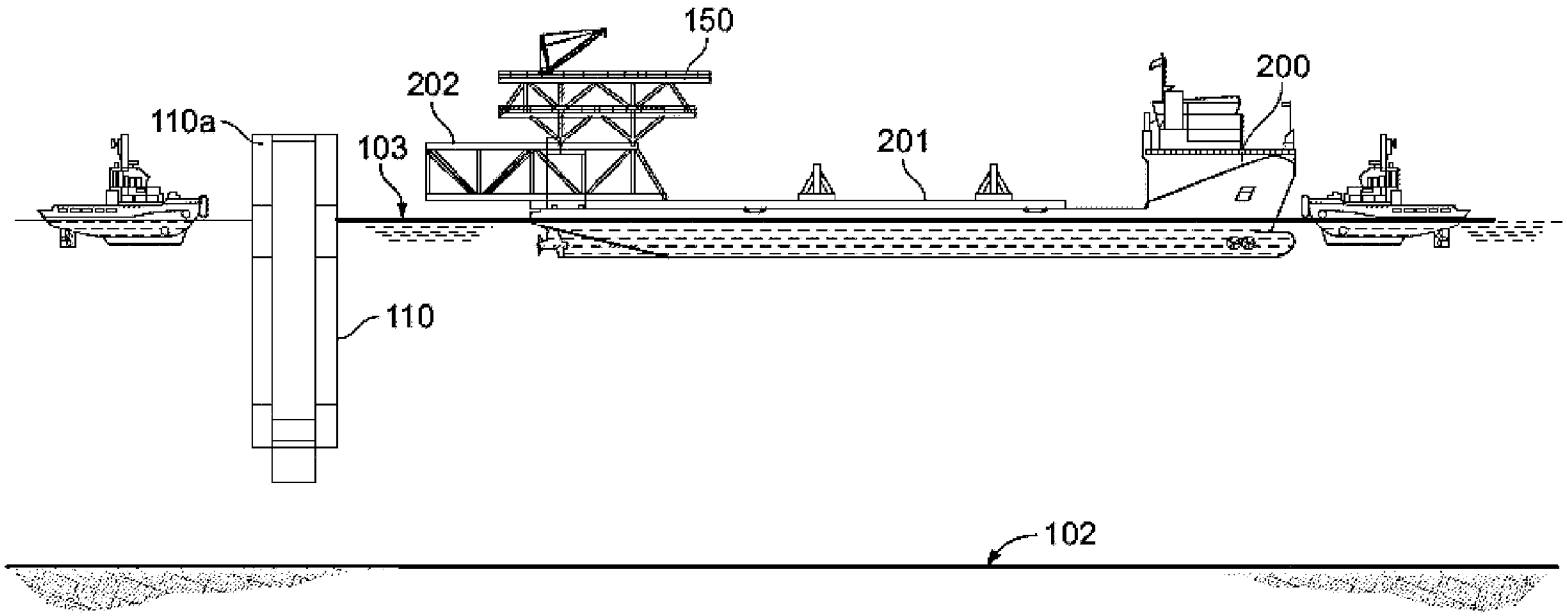
Figure 18:
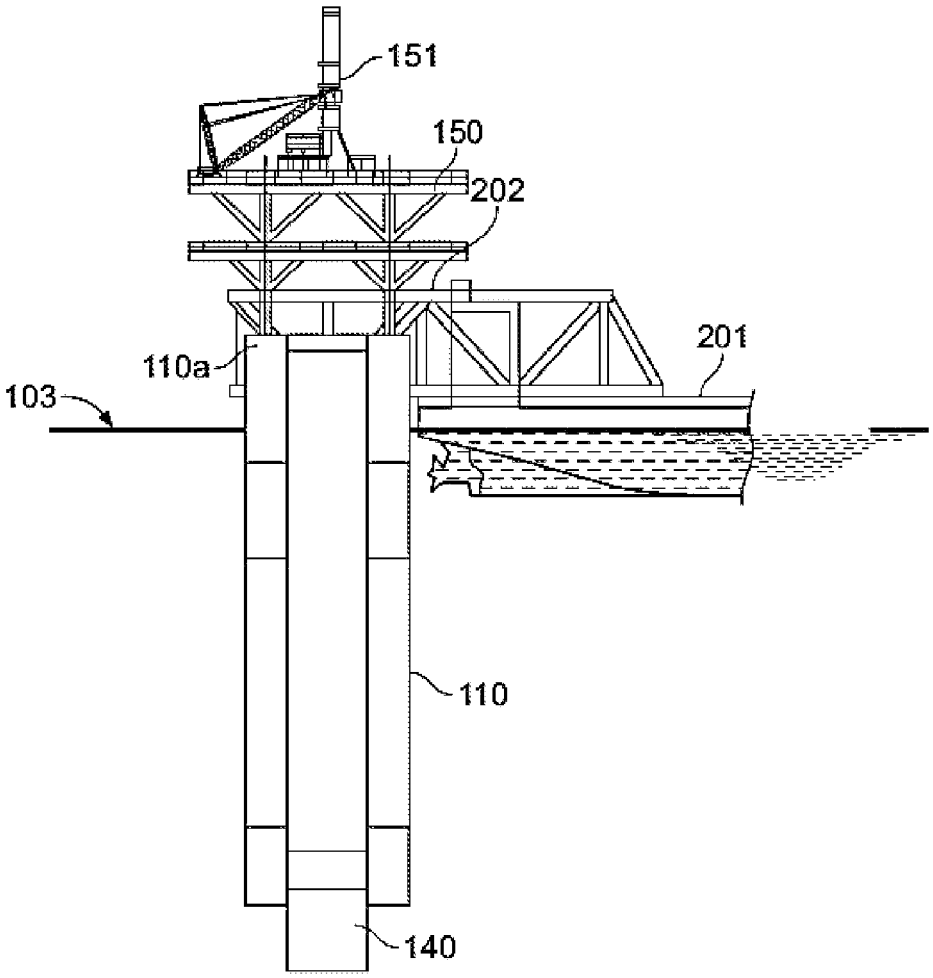

Moving now to FIGS. 17 and 18, topside 150 is mounted to vertical hull 110. As shown in FIG. 17, vessel 200 is deballasted and/or hull 110 is ballasted to raise the position of topside 150 relative to upper end 110*a* of hull 110. Hull 110 may be ballasted by simply venting air 106 from chambers 127, 137 and allowing water 101, 108 to flow into chambers 127, 137. Next, as shown in FIG. 18, vessel 200 and/or hull 110 are maneuvered to position rails 202 on opposite sides of hull 110, and topside 150 is advanced along rails 202 until it is positioned immediately over hull 110. With topside 150 sufficiently positioned over upper end 110*a*, hull 110 is deballasted and/or vessel 200 is ballasted such that hull 110 moves upward relative to topside 150, engages topside 150, and lifts topside 150 from rails 202, thereby mating topside 150 to hull 110 and forming tower 100. Hull 110 is deballasted by increasing the volume of air 106 and decreasing the volume of water 101, 108 in chambers 127, 137. At this point, tower 100 is net buoyant and may be laterally adjusted or moved as shown in FIG. 19. Although topside 150 is shown being mounted to upper end 110*a* of hull 110 via rails 202 in FIGS. 17 and 18, in other embodiments, topside 150 may be mounted to hull 110 using other suitable means. For example, topside 150 may be supported by two barges, hull 110 ballasted, topside 150 maneuvered by the barges over hull 110 with the barges disposed on either side of hull 110, and then hull 110 deballasted to lift topside 150 from hull 110. Up to this point, center column 130 is preferably maintained in the fully retracted and locked position by locking assemblies 95. Derrick 151 and cable 152 may also be employed to maintain center column 130 in the refracted position once center column 130 is no longer net buoyant.

Referring now to FIGS. 20 and 21, in this embodiment, tower 100 is moved to an offshore location having a greater water depth than the installation site, and center column 130 is lowered. Center column 130 is preferably axially lowered relative to outer columns 120 until the length $L_{110}$ of hull 110 is equal to the depth of the water at the installation site plus the desired freeboard. To axially lower center column 130, locking assemblies 195 are transitioned to the unlocked position, slack is provided to cable 152, and ballasting system 160 is employed to ballast center column 130 (e.g., by allowing air 106 to vent from chamber 137 and water 101, 108 to flow into chamber 137 via port 161). Center column 130 may be completely flooded, with the load of center column 130 completely supported by cable 152. Alternatively, center column 130 may be partially flooded to reduce the load that must be supported by cable 152. In either case, center column 130 is sufficiently ballasted so that it can be lowered axially downward relative to outer columns 120 with cable 152 and lifting device 151. Once anchor 140 is at the desired depth and the desired total length $L_{110}$ of hull 110 is achieved, locking assemblies 195 are transitioned to the locked position to fix the axial position of center column 130 relative to outer columns 120.

Figure 23:
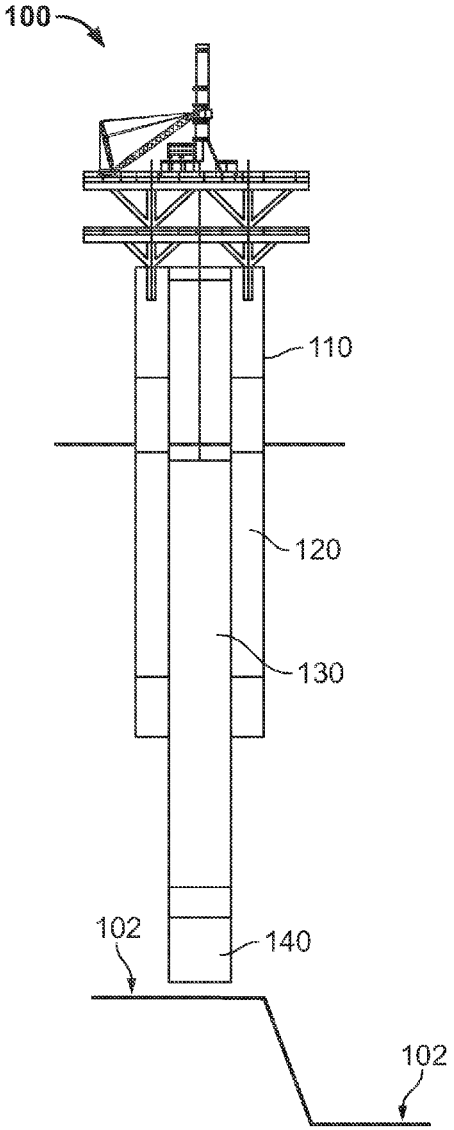
Figure 24:
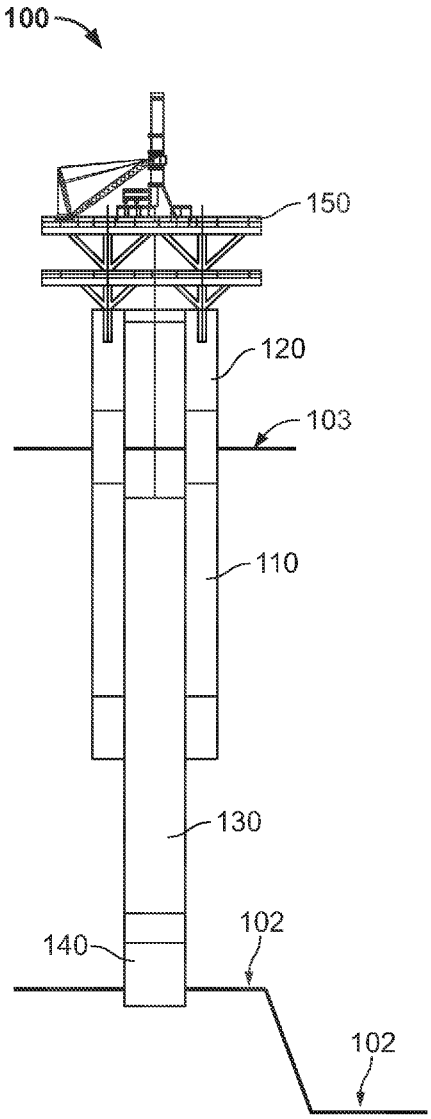
Figure 25:
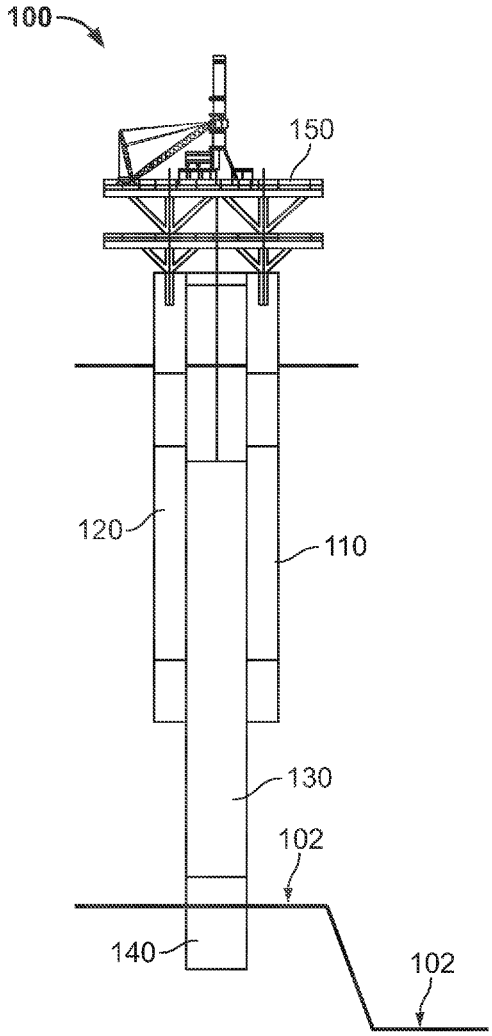

Moving now to FIGS. 22 and 23, with the axial position of center column 130 locked relative to outer columns 120, hull 110 is deballasted to raise tower 100, and tower 100 is moved laterally to the installation site. Tower 100 is preferably deballasted to a degree that clearance is provided between anchor 140 and the sea floor 102 as tower 100 is moved into the shallower water at the installation site. At the installation site, hull 110 is ballasted to bring anchor 140 is into engagement with the sea floor 102 and push skirt 141 into the sea floor 102 as shown in FIGS. 24 and 25. System 170 may be employed to apply suction to cavity 142 and facilitate the penetration of skirt 141 into the sea floor 102. With anchor 140 sufficiently embedded in the sea floor 102, the overall weight and buoyancy of tower 100 is adjusted as desired, by controlling the relative volumes of air 106 and water 101, 108 in chambers 127, 137, to maintain engagement of anchors 140 and the sea floor 102. In this embodiment, the total weight of tower 100 preferably exceeds the total buoyancy of tower 100 by about 250 to 1000 tons, and more preferably about 500 tons to ensure penetration of skirt 141 into sea floor 102 is maintained during subsequent drilling and/or production operations. The total load applied to skirt 141 (i.e., the difference between the total weight and total buoyancy of tower 100) may be varied and controlled as desired by ballasting and deballasting hull 110 using ballast control systems 160 previously described. During installation of anchor 140 and subsequent offshore operations at the installation site, locking assemblies 195 are preferably maintained in the locked position.

Although tower 100 has been shown and described as being moved into deeper waters to lower center column 130, deballasted, moved to the installation site, and then ballasted, in other embodiments, installation of tower 100 may be performed in a different manner. For example, hull 110 may be deballasted at the installation site, locking assemblies 195 unlocked, center column 130 lowered, locking assemblies 195 locked, and then tower 100 ballasted to set anchor 140.

Figure 26:
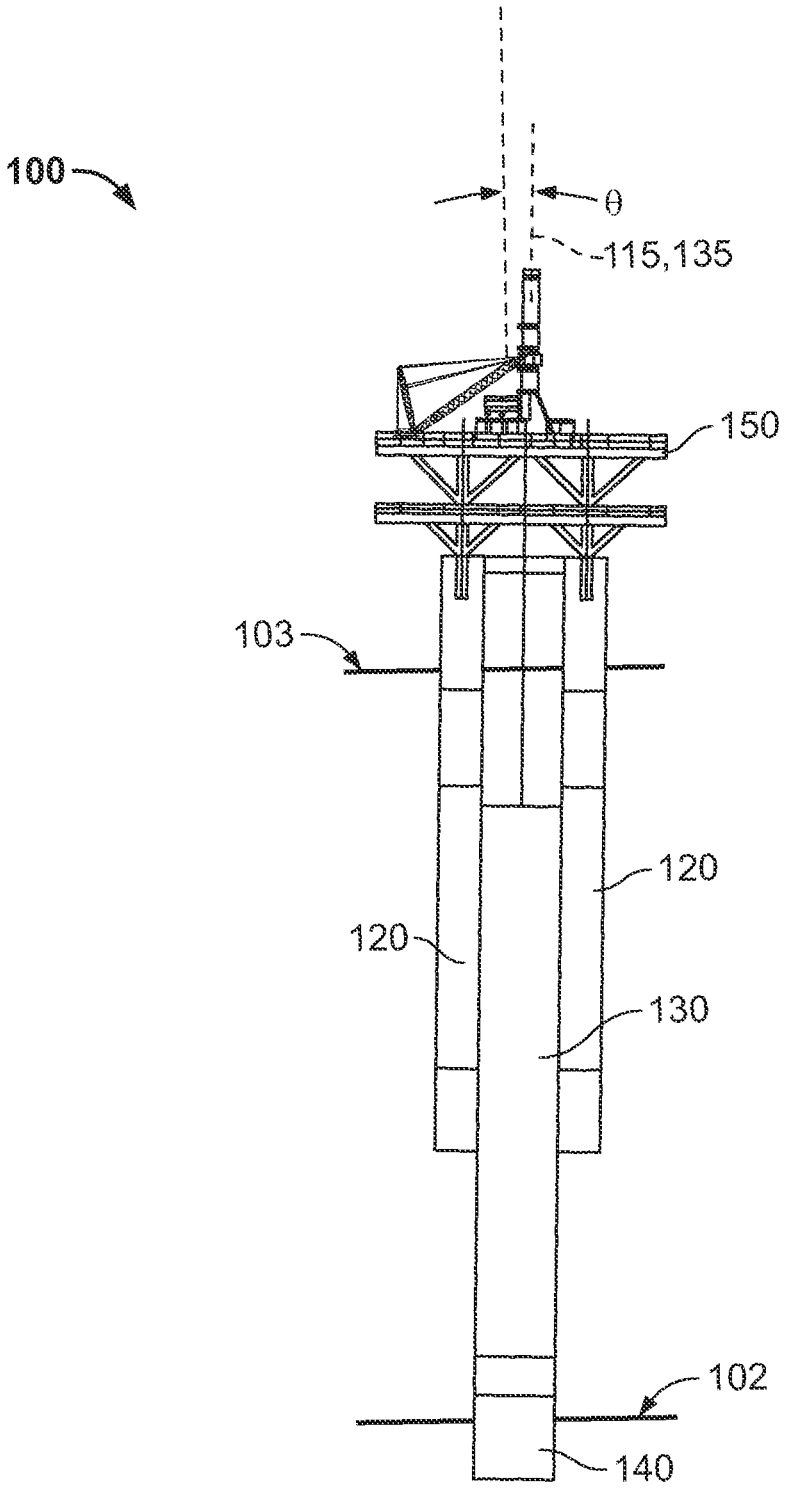
FIG. 26 is a front view of the tower of FIG. 1 secured to the sea floor and pivoting relative to the sea floor.

As best shown in FIG. 26, the relatively small net downward force in combination with the center of buoyancy 105 being positioned above the center of gravity 106, allows tower 100 to pivot or pitch from vertical relative to the sea floor 102 in response to environmental loads (e.g., wind, waves, currents, earthquakes, etc.). In FIG. 26, tower 100 is shown oriented at a pitch angle θ measured from vertical. The relationship between the position of center of gravity 106 and center of buoyancy 105 determines the pitch stiffness and maximum pitch angle θ of tower 100. In general, pitch stiffness and maximum pitch angle θ are inversely related. Thus, as pitch stiffness increases (i.e., resistance to pitch increases), the maximum pitch angle θ decreases; and as pitch stiffness decreases, the maximum pitch angle θ increase. The pitch stiffness and maximum pitch angle θ can be varied and controlled by adjusting the relative volumes of air 106 and water 101, 108 in chambers 127, 137 to control the location of center of gravity 106 and center of buoyancy 105. For example, as the volume of water 101, 108 in chambers 127, 137 is increased and the volume of air 106 in chambers 127, 137 is decreased, the center of buoyancy 105 moves upward and center of gravity 106 moves downward; and as the volume of water 101, 108 in chambers 127, 137 is decreased and the volume of air 106 in chambers 127, 137 is increased, the center of buoyancy 105 moves downward and center of gravity 106 moves upward. As center of gravity 106 and center of buoyancy 105 are moved apart (i.e., center of gravity 106 is moved downward and center of buoyancy 105 is moved upward), pitch stiffness increases and maximum pitch angle θ decreases; however, as center of gravity 106 and center of buoyancy 105 are moved toward each other (i.e., center of gravity 106 is moved upward and center of buoyancy 105 is moved downward), pitch stiffness decreases and maximum pitch angle θ increases. Thus, by controlling the relative volumes of air 106 and water 101, 108 in chambers 127, 137, the pitch stiffness and maximum pitch angle θ can be controlled. For embodiments described herein, the maximum pitch angle θ is preferably less or equal to 10°.

As previously described, embodiments of tower 100 described herein have a center of buoyancy 105 positioned above the center of gravity 106, thereby enabling tower 100 to respond to environmental loads and exhibit advantageous stability characteristics similar to floating spar platforms, which also have a center of buoyancy disposed above their center of gravity. A floating spar platform pitches about the lower end of its subsea hull, with its lateral position being maintained with a mooring system. Similarly, embodiments of tower 100 are free to pitch about lower end **110*b* of hull 110. However, lower end 110*b* is directly secured to the sea floor 102 with anchor 140, which provides resistance to lateral movement of tower 100. The relatively small vertical loads placed on anchor 140 as previously described (e.g., 250 to 1000 tons) serves to ensure that tower 100 has a sufficient amount of lateral load capacity to withstand environmental loads without disengaging the sea floor 102** or moving laterally. It should be appreciated that is in stark contrast to most conventional offshore structures that are typically placed in pure compression (fixed platforms and compliant towers) or pure tension (tension leg platforms).

As previously described, in embodiments described herein, anchor 140 is subjected to relatively lower vertical loads because tower 100 provides significant buoyancy. In addition, since tower 100 pivots from vertical about lower end **110*b*, anchor 140 serves as a pivoting joint. Suction skirt 141 provides a relatively simple mechanical apparatus designed and operated (e.g., depth of penetration into the sea floor 102 may be adjusted) based on the stiffness of the soil at the sea floor 102. In other words, if the soil at the sea floor 102 has a high stiffness, then skirt 141 may be partially embedded in the sea floor 102, and on the other hand, if the soil at the sea floor 102 has a low stiffness, then skirt 141 may be fully embedded in the sea floor 102. In other words, the depth of penetration of skirt 141 into the sea floor 102 may be dictated by the stiffness of the soil at the sea floor 102 to enable the desired dynamic behavior for tower 100 (e.g., pitch stiffness, maximum pitch angle θ, natural period, etc.). This approach of leveraging some of the inherent compliance of soil at the sea floor to provide pitch compliance for tower 100** offers potential advantages over complex articulating mechanical connections at the sea floor, which may be unreliable and/or a weak point for articulate towers.

Following offshore drilling and/or production operations at a first offshore installation site, tower 100 may be decoupled from the sea floor 102, moved to a second installation site, and installed at the second installation site. In general, tower 100 is decoupled from the sea floor 102 by reversing the order of the steps taken to install tower 100. For example, tower 100 may be deballasted by pumping air 106 into chambers 127 and forcing water 101, 108 out of chambers 127 through ports 161. To maintain control of center column 130 during subsequent raising of column 130, chamber 137 is preferably minimally deballasted or not deballasted at all. In particular, the buoyancy of column 130 is preferably maintained below the weight of column 130 during setting and removal of anchor 140. Tower 100 is deballasted until it is net buoyant, and thus, pulls upward on anchor 140. Simultaneously, cavity 142 is vented (by opening valves 174) to reduce the hydraulic lock between skirt 141 and the sea floor 102 and/or a fluid (e.g., water) is pumped into cavity 142 with injection pump 173 to urge skirt 141 upward relative to the sea floor 102. Once anchor 140 is completely pulled from the sea floor 102, tower 100 is free floating and may be towed to the second installation location and installed. If the depth of the water is sufficiently different at the second installation site, locking assemblies 195 may be transitioned to the unlocked position to allow the axial position of center column 130 to be adjusted, and then transitioned back to the locked position.

In the manner described, embodiments described herein (e.g., tower 100) include a hull (e.g., hull 110) with a plurality of cellular cylindrical columns (e.g., columns 120, 130 comprising chambers 126, 127, 128, 129, 136, 137). Such cellular columns offer the potential to enhance fabrication and installation efficiencies as compared to most conventional jackets for fixed platforms and truss structures for compliant towers, particularly in geographic regions with limited experience and skilled resources. In addition, embodiments described herein offer potential advantages in earthquake zones as they may pitch about lower end 110*b*, and are not rigid bottom-founded structures.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. An offshore structure, comprising:

a hull having a longitudinal axis and including a first column and a second column moveably coupled to the first column, wherein the second column is configured to move axially relative to the first column, wherein each column has a longitudinal axis, a first end, and a second end opposite the first end;

an anchor disposed at the second end of the second column;

wherein the second column is configured to move axially down relative to the first column to urge the anchor into the sea floor and secure the hull to the sea floor;

wherein the first column includes a variable ballast chamber positioned axially between the first end and the second end of the first column and a first buoyant chamber positioned between the variable ballast chamber and the first end of the first column, wherein the first buoyant chamber is filled with a gas and sealed from the surrounding environment;

wherein the second column includes a variable ballast chamber positioned axially between the first end and the second end of the second column; and a topside mounted to the hull.

2. The offshore structure of claim 1, wherein the anchor has an aspect ratio less than 3:1.

3. The offshore structure of claim 1, further comprising:

a first ballast control conduit in fluid communication with the variable ballast chamber of the first column and configured to supply a gas to the variable ballast chamber of the first column;

wherein the first column includes a first port in fluid communication with the variable ballast chamber of the first column, wherein the first port of the first column is configured to allow water to flow into and out of the variable ballast chamber of the first column from the surrounding environment;

a second ballast control conduit in fluid communication with the variable ballast chamber of the second column and configured to supply a gas to the variable ballast chamber of the second column;

wherein the second column includes a first port in fluid communication with the variable ballast chamber of the second column, wherein the first port of the second column is configured to allow water to flow into and out of the variable ballast chamber of the second column from the surrounding environment.

4. The offshore structure of claim 3, wherein the first ballast control conduit has an end disposed within the variable ballast chamber of the first column, and the second ballast control conduit has an end disposed within the variable ballast chamber of the second column.

5. The offshore structure of claim 1, wherein the first column includes a fixed ballast chamber axially positioned between the variable ballast chamber of the first column and the second end of the first column;

wherein the second column includes a fixed ballast chamber axially positioned between the variable ballast chamber of the second column and the second end of the second column;

wherein each fixed ballast chamber is configured to be filled with fixed ballast.

6. The offshore structure of claim 1, wherein the anchor is a suction pile including a suction skirt extending axially from the second end of the second column.

7. The offshore structure of claim 6, further comprising a fluid conduit in fluid communication with a cavity defined by the suction skirt, wherein the fluid conduit is configured to vent the cavity, pump a fluid into the cavity, or draw the fluid from the cavity.

8. The offshore structure of claim 1, further comprising a second buoyant chamber disposed at the first end of the first column, wherein the second buoyant chamber is filled with a gas and sealed from the surrounding environment.

9. The offshore structure of claim 1, further comprising a locking assembly configured to selectively lock an axial position of the second column relative to the first column.

10. The offshore structure of claim 9, further comprising:

an elongate guide coupled to the first column and extending parallel to the longitudinal axis of the first column;

an elongate rail coupled to the second column, wherein the rail is oriented parallel to the longitudinal axis of the second column;

wherein the rail is disposed within and slidingly engages the guide;

wherein the locking assembly is positioned between the rail and the guide.

11. A method, comprising:

(a) positioning a buoyant tower at an offshore installation site, wherein the tower includes a hull having a longitudinal axis and a topside mounted to the hull, wherein the hull includes a center column and a plurality of outer columns circumferentially spaced about the center column, wherein the center column has an anchor disposed at a lower end and is moveably coupled to the outer columns;

(b) ballasting the center column;

(c) moving the center column axially downward relative to the outer columns during (b);

(d) ballasting the outer columns;

(e) penetrating the sea floor with the anchor of the second column during step (c); and (f) allowing the tower to pitch about the anchor after step (e).

12. The method of claim 11, further comprising selectively locking the position of the center column relative to the outer columns before step (e).

13. The method of claim 11, wherein step (d) comprises allowing the tower to pitch to a maximum pitch angle relative to vertical that is less than 10°.

14. The method of claim 11, wherein the anchor has an aspect ratio less than 3:1.

15. The method of claim 11, wherein step (a) comprises:

(a1) transporting the hull and the topside to the offshore installation site;

(a2) floating the hull at the sea surface in a horizontal orientation;

(a3) transitioning the hull from the horizontal orientation to a vertical orientation;

(a4) mounting the topside to the hull above the sea surface to form the buoyant tower.

16. The method of claim 15, wherein step (a1) comprises:

transporting the hull offshore on a vessel; and unloading the hull from the vessel offshore.

17. The method of claim 11, wherein each outer column has longitudinal axis, a first end, and a second end opposite the first end;

wherein each outer column includes a variable ballast chamber positioned axially between the first end and the second end of the outer column and a first buoyant chamber positioned axially between the variable ballast chamber and the first end of the outer column;

wherein step (b) comprises flowing variable ballast into the variable ballast chamber of each outer column;

wherein the center column has a longitudinal axis, a first end, a second end opposite the first end;

wherein the center column includes a variable ballast chamber positioned axially between the first end and the second end of the center column;

wherein step (c) comprises flowing variable ballast into the variable ballast chamber of the center column.

18. The method of claim 17, wherein step (c) comprises allowing a gas in the variable ballast chamber of the center column to vent and allowing water to flow into the variable ballast chamber of the center column through a port in the center column.

19. The method of claim 11, wherein the anchor is a suction pile including a suction skirt extending axially from the second end of the center column;

wherein step (e) comprises:

(e1) penetrating the sea floor with the suction skirt; and (e2) pumping a fluid from a cavity within the suction skirt during step (e1).

20. The method of claim 19, further comprising:

(g) deballasting the hull after step (f); and (h) pulling the anchor from the sea floor.

21. The method of claim 20, further comprising:

pumping a fluid into the cavity during step (h).

22. An offshore structure, comprising:

a hull having a longitudinal axis and including a plurality of radially outer columns and a center column radially positioned between the outer columns, wherein each column is oriented parallel to the longitudinal axis;

wherein each column has a first end and a second end opposite the first end;

wherein the center column is configured to move axially relative to the outer columns;

an anchor disposed at the second end of the center column, wherein the anchor has an aspect ratio less than 3:1 and is configured to releasably engage the sea floor;

wherein each of the plurality of outer columns includes a variable ballast chamber positioned axially between the first end and the second end of the corresponding outer column and a first buoyant chamber positioned axially between the variable ballast chamber and the first end of the corresponding outer column, wherein the first buoyant chamber is filled with a gas and sealed from the surrounding environment;

wherein the center column includes a variable ballast chamber positioned axially between the first end and the second end of the center column;

a topside mounted to the hull; and a locking assembly configured to selectively lock an axial position of the center column relative to the outer columns.

23. The offshore structure of claim 22, further comprising a plurality of first conduits, wherein one of the first conduits is in fluid communication with one of the variable ballast chambers and is configured to supply a gas to the corresponding variable ballast chamber.

24. The offshore structure of claim 23, wherein each of the plurality of outer columns includes a fixed ballast chamber positioned axially between the corresponding variable ballast chamber and the second end of the corresponding outer column.

25. The offshore structure of claim 24, further comprising a plurality of second conduits, wherein one of the second conduits is in fluid communication with each fixed ballast chamber and is configured to supply fixed ballast to the corresponding fixed ballast chamber.

26. The offshore structure of claim 22, wherein the anchor is a suction pile including a suction skirt.

27. The offshore structure of claim 26, further comprising a fluid conduit in fluid communication with a cavity within the suction skirt and configured to withdraw fluid from the cavity and pump fluid into the corresponding cavity.

28. The offshore structure of claim 22, wherein each of the center column and the plurality of outer columns includes a port in fluid communication with the corresponding variable ballast chamber.

* * * * *